US007354125B2

(12) United States Patent
Hirayama et al.

(10) Patent No.: US 7,354,125 B2
(45) Date of Patent: Apr. 8, 2008

(54) ELEMENT BOARD FOR PRINTHEAD, AND PRINTHEAD HAVING THE SAME

(75) Inventors: Nobuyuki Hirayama, Kanagawa (JP); Ryo Kasai, Tokyo (JP); Masataka Sakurai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 230 days.

(21) Appl. No.: 11/010,278

(22) Filed: Dec. 14, 2004

(65) Prior Publication Data

US 2005/0134620 A1 Jun. 23, 2005

(30) Foreign Application Priority Data

Dec. 18, 2003 (JP) ..... 2003-421353
Dec. 2, 2004 (JP) ..... 2004-350301

(51) Int. Cl.
*B41J 29/38* (2006.01)

(52) U.S. Cl. ..... 347/12; 347/58; 347/59

(58) Field of Classification Search ..... 347/9, 347/12–13, 40, 42, 56–59, 5, 50
See application file for complete search history.

(56) References Cited

U.S. PATENT DOCUMENTS 6,520,613 B1 2/2003 Tamura ..... 347/12
2002/0036781 A1 3/2002 Hirayama ..... 358/1.4
2003/0142153 A1 7/2003 Nakajima et al. ..... 347/9
2004/0021731 A1 2/2004 Yabe et al. ..... 347/40

FOREIGN PATENT DOCUMENTS

| | | |
|---|---|---|
| EP | 0 816 110 | 1/1998 |
| EP | 1 172 211 | 1/2002 |
| JP | 9-327914 | 12/1997 |
| JP | 11-300973 | 11/1999 |
| JP | 2002-29055 | 1/2002 |

*Primary Examiner*—Lam Son Nguyen
(74) *Attorney, Agent, or Firm*—Fitzpatrick, Cella, Harper & Scinto

(57) ABSTRACT

In a printhead element board including a plurality of printing elements which align in a predetermined direction, driving circuits which drive the printing elements, and an element selection circuit which selects printing elements within each group for each group having a predetermined number of adjacent printing elements, a plurality of element selection circuits are laid out adjacent to the driving circuits of the respective groups. With this layout, even if the number of printing elements increases, only the length in the printing element array direction increases without increasing the length in a direction perpendicular to the printing element array direction.

18 Claims, 31 Drawing Sheets

DATAB
X BIT S/R + LATCH
106
X TO N DECORDER
105
108
107
104
103
102
101
S/R + LATCH
G1
G2
G(M-1)
G(M)
LT
CLK
DATA
HE
GND
VH

DATA
X BIT S/R + LATCH
106
502
108
501
103
102
101
G1
G2
G(M-1)
G(M)
S/R + LATCH
LT
CLK
DATA
HE
GND
VH

FIG. 19

| N, M | TOTAL NUMBER OF SRS | TOTAL NUMBER OF DECS | TOTAL AREA |
|---|---|---|---|
| N = 256, M = 1 | 9 | 256 | 274 |
| N = 128, M = 2 | 9 | 128 | 146 |
| N = 64, M = 4 | 10 | 64 | 84 |
| N = 32, M = 8 | 13 | 32 | 58 |
| N = 16, M = 16 | 20 | 16 | 56 |
| N = 8, M = 32 | 35 | 8 | 78 |
| N = 4, M = 64 | 66 | 4 | 136 |
| N = 2, M = 128 | 129 | 2 | 260 |
| N = 1, M = 256 | 256 | 1 | 513 |

FIG. 30

| CODE 0 | CODE 1 | CODE 2 | CODE 3 | OUTPUT HIGH |
|---|---|---|---|---|
| L | L | L | L | BE0 |
| L | L | L | H | BE1 |
| L | L | H | L | BE2 |
| L | L | H | H | BE3 |
| L | H | L | L | BE4 |
| L | H | L | H | BE5 |
| L | H | H | L | BE6 |
| L | H | H | H | BE7 |
| H | L | L | L | BE8 |
| H | L | L | H | BE9 |
| H | L | H | L | BE10 |
| H | L | H | H | BE11 |
| H | H | L | L | BE12 |
| H | H | L | H | BE13 |
| H | H | H | L | BE14 |
| H | H | H | H | BE15 |

ELEMENT BOARD FOR PRINTHEAD, AND PRINTHEAD HAVING THE SAME

FIELD OF THE INVENTION

The present invention relates to an element board for a printhead and a printhead having the same and, more particularly, to the layout of an element board for a printhead on which a plurality of printing elements that align in a predetermined direction and divided into a plurality of groups for a predetermined number of printing elements, and a driving circuit for driving the printing elements are formed on the same element board.

BACKGROUND OF THE INVENTION

As an information output apparatus in a wordprocessor, personal computer, facsimile apparatus, and the like, a printing apparatus which prints information such as a desired character or image on a sheet-like printing medium such as a paper sheet or film widely adopts a serial printing method of printing by reciprocal scanning in a direction perpendicular to the feed direction of a printing medium such as a paper sheet because this method can achieve cost reduction and easy downsizing.

The structure of a printhead used in such a printing apparatus will be explained by exemplifying a printhead complying with an inkjet method of printing using thermal energy. In the inkjet printhead, a heating element (heater) is arranged as a printing element at a portion communicating with an orifice (nozzle) for discharging ink droplets. The inkjet printhead prints by supplying a current to the heating element to generate heat, and bubbling ink to discharge ink droplets. This printhead makes it easy to arrange many orifices and heating elements (heaters) at high densities, and can obtain a high-resolution printed image.

In order to print by such a printhead at a high speed, it is desirable to simultaneously drive heaters as many as possible. However, the number of simultaneously drivable heaters is limited because the current supply capability of the power supply is limited, and the voltage drop by the parasitic resistance of a wiring line increases with an increase in current and inhibits supply of desired energy to the heater. From this, a plurality of heaters are divided into groups, and heaters within each group are driven (time division driving) with a time lag so as not to simultaneously drive them, suppressing the maximum value of a current which flows instantaneously.

An example of a circuit configuration which performs this driving is disclosed in, e.g., U.S. Pat. No. 6,520,613 (Japanese Patent Laid-Open No. 9-327914).

The circuit configuration disclosed in U.S. Pat. No. 6,520,613 (Japanese Patent Laid-Open No. 9-327914) performs matrix driving of selecting an arbitrary heater on the basis of the ANDs between outputs from registers for storing M data and N block selection signals when M×N heaters are to be driven for M heaters N times in time division. This configuration can reduce the circuit scale, and hardly malfunctions because data is transferred in time division.

FIG. 7 is a circuit diagram showing an example of the configuration of a driving circuit on an element board. In FIG. 7, reference numerals 101 denote heaters serving as printing elements; 102, transistors which drive the respective heaters; 103 and 104, AND circuits which AND logical signal inputs; 105, an X to N decoder which decodes an X-bit block control signal supplied from a printer main body and selects one of N block selection lines; and 106, a shift register+latch circuit which stores, in synchronism with a CLK signal, the X-bit block control signal transferred in a serial format from the printer main body and latches the block control signal by an LT signal.

N heaters 101, N transistors 102, and N AND circuits 103 and 104 form one group G1. The heaters 101, transistors 102, and AND circuits 103 and 104 are divided for N each into M groups G1 to GM. Reference numeral 1001 denotes a shift register+latch circuit including an M-bit shift register which sequentially stores printing data serially transferred in synchronism with the clock signal CLK supplied from the printer main body, and a latch circuit which latches serial data in accordance with the latch signal LT. M data signal lines 1002 run from the shift register+latch circuit 1001.

N block selection lines 107 are respectively connected to the inputs of the N AND circuits 104 which form a corresponding one of the groups G1 to GM. The other inputs of the AND circuits 104 are commonly connected within each group, and data signal lines are connected to the commonly connected wiring lines.

The operation of the driving circuit in FIG. 7 will be explained with reference to the timing chart of FIG. 8. The timing chart in FIG. 8 corresponds to one sequence (one discharge cycle) during which an arbitrary heater can be selected once from M×N heaters. That is, a cycle until the same heater is so selected as to be able to drive it again is defined as one cycle.

M-bit data corresponding to image data are serially transferred to the shift register+latch circuit 1001 by a DATA signal synchronized with the clock signal CLK. When the latch signal LT changes to "High" (high level), the input serial data are latched and output to the data lines 1002. The timings of the M data lines 1002 correspond to a DATAOUT signal in FIG. 8, and an arbitrary data line corresponding to image data among the M data lines changes to "High".

Similarly, an X-bit block control signal is also serially transferred to the shift register+latch circuit 106 in synchronism with the clock signal CLK. When the latch signal LT changes to "High", the X-bit block control signal is held by the decoder 105. The output timing from the decoder 105 to the block selection lines 107 corresponds to the timing of a block enable signal BE (FIG. 8) for selecting a block. The X-bit block control signal selects one of N outputs from the output lines 107, and the selected output changes to "High".

Of M driving circuits commonly connected to one block selection line, an arbitrary heater for which DATAOUT changes to "High" is selected by the AND circuit. A current I flows through the selected heater in accordance with an HE signal, driving the heater.

This operation is sequentially repeated N times. M×N heaters are driven for M heaters N times in time division, and all the heaters can be selected in accordance with image data.

More specifically, M×N heaters are divided into M groups each formed from N heaters. Heaters within each group are controlled so that one sequence is divided by N so as not to simultaneously drive two or more heaters and M-bit image data are simultaneously printed within the divided time.

A layout method of efficiently laying out the driving circuit in FIG. 7 on an element board formed from a semiconductor base plate is disclosed in, e.g., Japanese Patent Laid-Open No. 11-300973.

FIG. 9 shows an example of laying out the circuit in FIG. 7 on an element board. Ink which is supplied from the lower surface of the element board via an ink supply port 701 at the center of the element board is supplied via the supply port onto the upper surface of the element board having heaters.

The heaters generate heat to bubble ink, and as a result, ink supplied to the heaters is discharged in a direction perpendicular to the upper surface of the element board from nozzles formed on the upper surface of the element board.

In the layout shown in FIG. 9, heater groups 702 each having M×N heaters are symmetrically laid out in two arrays on the two sides of the ink supply port 701.

In FIG. 9, pad portions 709 and 710 for electrical connection to the apparatus main body are laid out on the two sides (short sides) in a direction crossing to the array direction of the heater group 702 on the element board. Shift registers+latches+decoder circuits 707 and shift registers+latch circuits 708 are interposed between the pad portions, and the heaters and driving circuit groups 703 and 704. Data output lines 705 running from the shift registers+latch circuits 708 and block selection lines 706 running from the shift registers+latches+decoder circuits 707 are laid out parallel to the heater groups 702. Data output lines 705 are formed from M data lines, and block selection lines 706 are formed from N block selection lines.

The correspondence between building components in the circuit diagram of FIG. 7 and regions in the layout of FIG. 9 will be explained. The heaters 101 are formed in the region 702; the transistors 102, in the region 703; the AND circuits 103 and 104, in the region 704; the data lines 1002, in the region 705; the block selection lines 107, in the region 706; the shift register+latch circuit 106 and decoder 105, in the region 707; and the shift register+latch circuit 1001, in the region 708.

As the number of printing elements (heaters) of the printhead increases for meeting demands for higher image qualities and higher speeds, the following problems arise.

When M×N heaters are matrix-driven, the number of wiring lines for either or both of the M data lines and N block selection lines must be increased in accordance with an increase in the number of heaters.

At this time, if the number of the heaters in one block N which determines the driving frequency of the heaters increases, ink discharging frequency for one nozzle is decreases, and hence the number N cannot increase. For performing high speed printing by increasing the number of nozzles, it is required to increase the number M which corresponds to the number of groups and represents the number of data lines and to increase the number of nozzles driven at the same time. As a result, the length of the short side of data lines wiring region 705 extending parallel to the heater array would increase in the circuit layout on the element board.

In general, heaters are laid out along the ink supply port, and an element board having many heaters has a rectangular shape long in the heater array direction and short in a crossing direction in order to effectively utilize the area of the element board.

If the short side of the wiring region parallel to the heater array becomes longer along with an increase in the number of heaters, the short side of the rectangular element board also becomes longer.

A circuit on the element board is built in a semiconductor wafer serving as a base plate (substrate). In order to reduce the cost of the element board, the area of the element board must be reduced to increase the number of element boards formed from one wafer.

However, as the short side of the rectangular plate-like element board (element substrate) becomes longer, the area of the element board increases, the number of element boards formed from one wafer greatly decreases, and the cost of one element board rises.

SUMMARY OF THE INVENTION

It is an object of the present invention to provide a printhead element board whose area does not increase even upon an increase in the number of printing elements.

It is another object of the present invention to provide a printhead having a printhead element board whose area does not increase even upon an increase in the number of printing elements.

In order to achieve the above objects, according to an aspect of the present invention, there is provided an element board for a printhead comprising: a plurality of printing elements which align in a predetermined direction; driving circuits which drive the printing elements; an element selection circuit which selects printing elements within each group, each group having a predetermined number of adjacent printing elements, on the basis of image data; and a driving selection circuit which selects one of the printing elements in each group, wherein at least one of the element selection circuit and the driving selection circuit is arranged adjacent to the driving circuit of each group.

More specifically, according to the present invention, in an element board for a printhead comprising a plurality of printing elements which align in a predetermined direction, driving circuits which drive the printing elements, and an element selection circuit which selects printing elements within each group for each group having a predetermined number of adjacent printing elements, a plurality of element selection circuits are laid out adjacent to the driving circuits of the respective groups.

Alternatively, in a printhead element board comprising a plurality of printing elements which align in a predetermined direction, driving circuits which drive the printing elements, an element selection circuit which selects printing elements within each group for each group having a predetermined number of adjacent printing elements, and a driving selection circuit which selects one of the printing elements within each group, a plurality of driving selection circuits are laid out adjacent to the driving circuits of the respective groups.

With this layout, even if the number of printing elements increases, only the length in the printing element array direction increases without increasing the length in a direction perpendicular to the printing element array direction.

Hence, the number of element boards formed from one wafer does not greatly decrease even upon an increase in the number of printing elements, suppressing cost rise per element board.

In a conventional layout, as the wiring line becomes longer, the resistance and inductance increase, and a signal delay and malfunction by noise readily occur. To the contrary, the present invention which shortens the wiring distance of a signal line by arranging at least one of the element selection circuit and the driving selection circuit adjacent to the corresponding driving circuit group, implements high-speed data transfer, and enhances the reliability against malfunction due to signal delay and/or noise.

The predetermined direction may be a longitudinal direction of an elongated ink supply port formed in the element board to supply ink, and printing elements and the driving circuits may be sequentially arranged from a side of the ink supply port.

In this case, the printing elements and the driving circuits may be arranged, respectively, on two sides of the ink supply port of the element board.

Further, a pad portion for electrical connection may be formed along a side of the element board which is crossing to the predetermined direction.

The printing elements, the driving circuits, and the element selection circuit may be sequentially arranged from the side of the ink supply port.

The element selection circuit may be arranged between the driving circuits respectively corresponding to adjacent ones of the groups.

Further, the driving selection circuit may be arranged adjacent to the element selection circuit.

Alternatively, the driving selection circuit may be arranged between the driving circuits corresponding to adjacent ones of the groups.

Otherwise, the driving circuit and element selection circuit which correspond to respective group may be arranged parallel to each other within a length of the printing elements of the respective group in the predetermined direction.

The driving selection circuit may be arranged in a line with the element selection circuit of a corresponding one of the groups.

Alternatively, the driving selection circuit may be arranged parallel to the element selection circuit of a corresponding one of the groups.

The printing element may include a thermal transducer which generates thermal energy for discharging ink.

The element selection circuit may include a shift register and a latch.

For example, the element selection circuit includes a one-bit shift register and a latch, and connected in series.

The driving circuit may comprise a driving transistor and an AND circuit in correspondence with each of the printing elements.

Further, the driving selection circuit may include a decoder.

According to another aspect of the present invention, there is provided a printhead having the above element board for a printhead.

According to still other aspects of the present invention, there are provided a printhead cartridge comprising the above printhead and an ink container which holds ink to be supplied to the printhead, and a printing apparatus comprising the above printhead and control means for supplying printing data to the printhead.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 19 is a table showing relationships among the number of shift registers, the number of decoders and total area when the number of time division N and the number of groups M are changed;

FIG. 30 is a truth table of the decoder of FIG. 29; and

DETAILED DESCRIPTION OF THE PREFERRED EMBODIMENTS

Preferred embodiments of the present invention will now be described in detail in accordance with the accompanying drawings. Note that each of constitution elements described in the following embodiments is only an example, and is not intended to limit the scope of the present invention thereto.

In this specification, "element board" (to be also referred to as a "substrate" hereinafter) includes not only a base plate made of a silicon semiconductor but also a base plate bearing elements and wiring lines. Moreover, the form of the substrate may be a board or a chip type substrate.

Further, "on an element board" means "the surface of an element board" or "the inside of an element board near its surface" in addition to "on an element board". "Built-in" in the present invention does not represent a simple layout of separate elements on a base, but represents integral formation/manufacture of elements on a substrate by a semiconductor circuit manufacturing process.

First Embodiment

Figure 1:
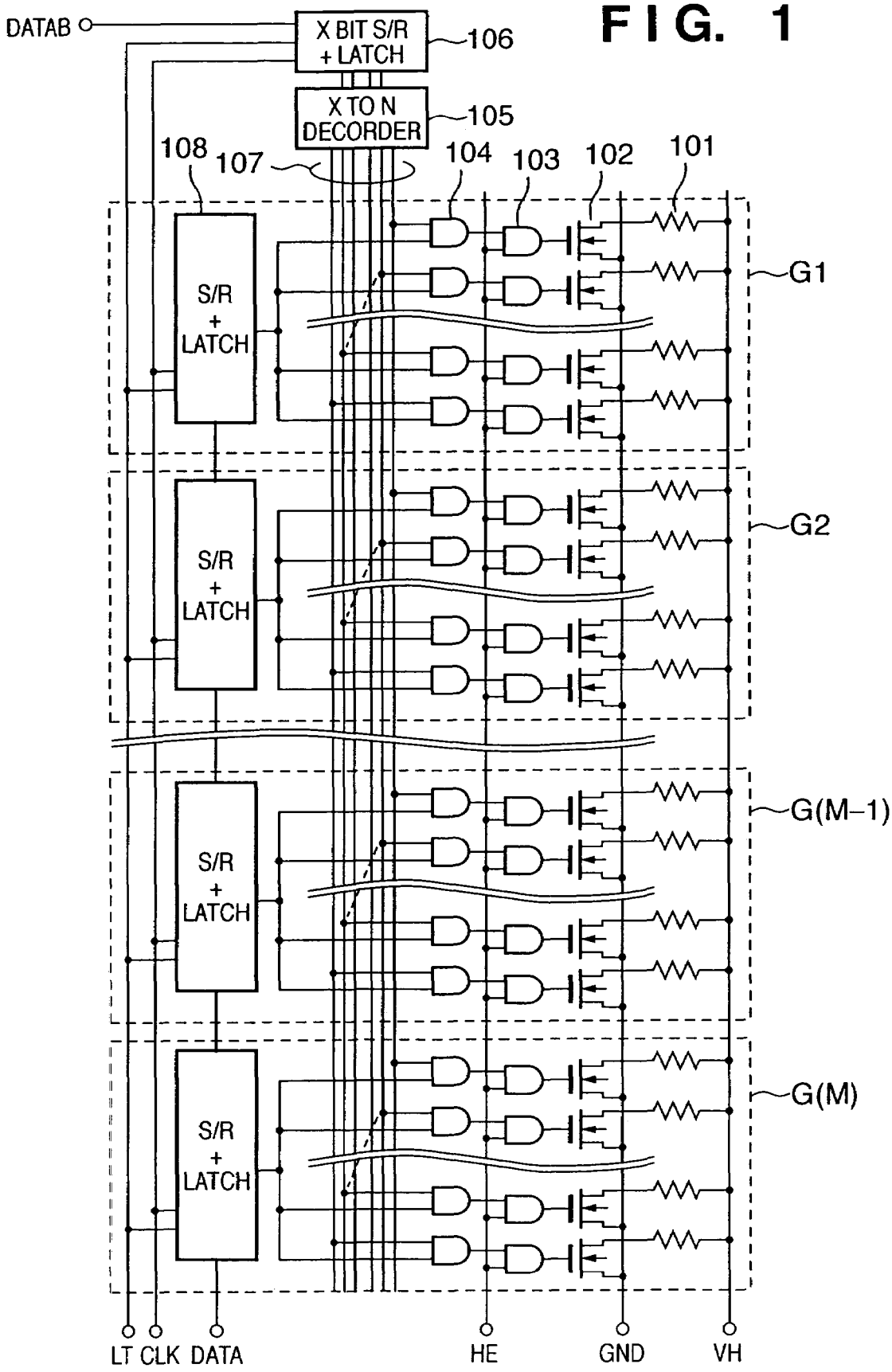
FIG. 1 is a circuit diagram showing a printhead according to the first embodiment of the present invention.

The first embodiment of a printhead according to the present invention will be described. FIG. 1 is a circuit diagram showing a printhead which performs matrix driving of selecting an arbitrary heater on the basis of the ANDs between outputs from registers for storing M data and block selection signals which are N decoder signal outputs so as to drive M×N heaters for M heaters N times in time division. Elements are built in an element board.

In FIG. 1, reference numerals 101 denote heaters serving as printing elements; 102, transistors which drive the respective heaters; 103 and 104, AND circuits which AND logical signal inputs; 105, an X to N decoder which decodes an X-bit block control signal supplied from a printer main body and selects one of N block selection lines; and 106, a shift register+latch circuit which stores, in synchronism with a CLK signal, the block control signal serially transferred from the printer main body and latches the block control signal by an LT signal.

In this embodiment, a shift register of one bit and a latch of one bit are provided for one group, and one group is defined as an unit in which one heater is driven at one time.

N heaters 101, N transistors 102, N AND circuits 103, and N AND circuits 104 form one group G1. The heaters 101, transistors 102, AND circuits 103, and AND circuits 104 are divided for N each into M groups G1 to GM. Reference numerals 108 denote shift registers+latch circuits each formed from a 1-bit shift register which serially transfers and stores printing data in synchronism with the clock signal CLK supplied from the printer main body and a latch which latches serial data in accordance with the latch signal LT. M shift registers+latch circuits 108 are arranged in correspondence with the groups G1 to GM. The output of the first shift register+latch circuit is connected to the input of the second shift register+latch circuit, and the output of the second shift register+latch circuit is connected to the input of the third shift register+latch circuit. Similarly, the M shift registers+latch circuits 108 are serially connected. In this arrangement, a plurality of heaters is not driven at the same time in every group.

The output of each shift register+latch circuit 108 is connected to the inputs of the AND circuits 104 in a corresponding one of the groups G1 to GM.

N block selection lines 107 are respectively connected to corresponding inputs of the N AND circuits 104 which form the groups G1 to GM.

In the circuit of FIG. 1, each shift register+latch circuit 108 stores and latches 1-bit data in correspondence with a corresponding group. The M shift registers for the respective groups are connected to each other to form an M-bit shift register as a whole.

Figure 15:
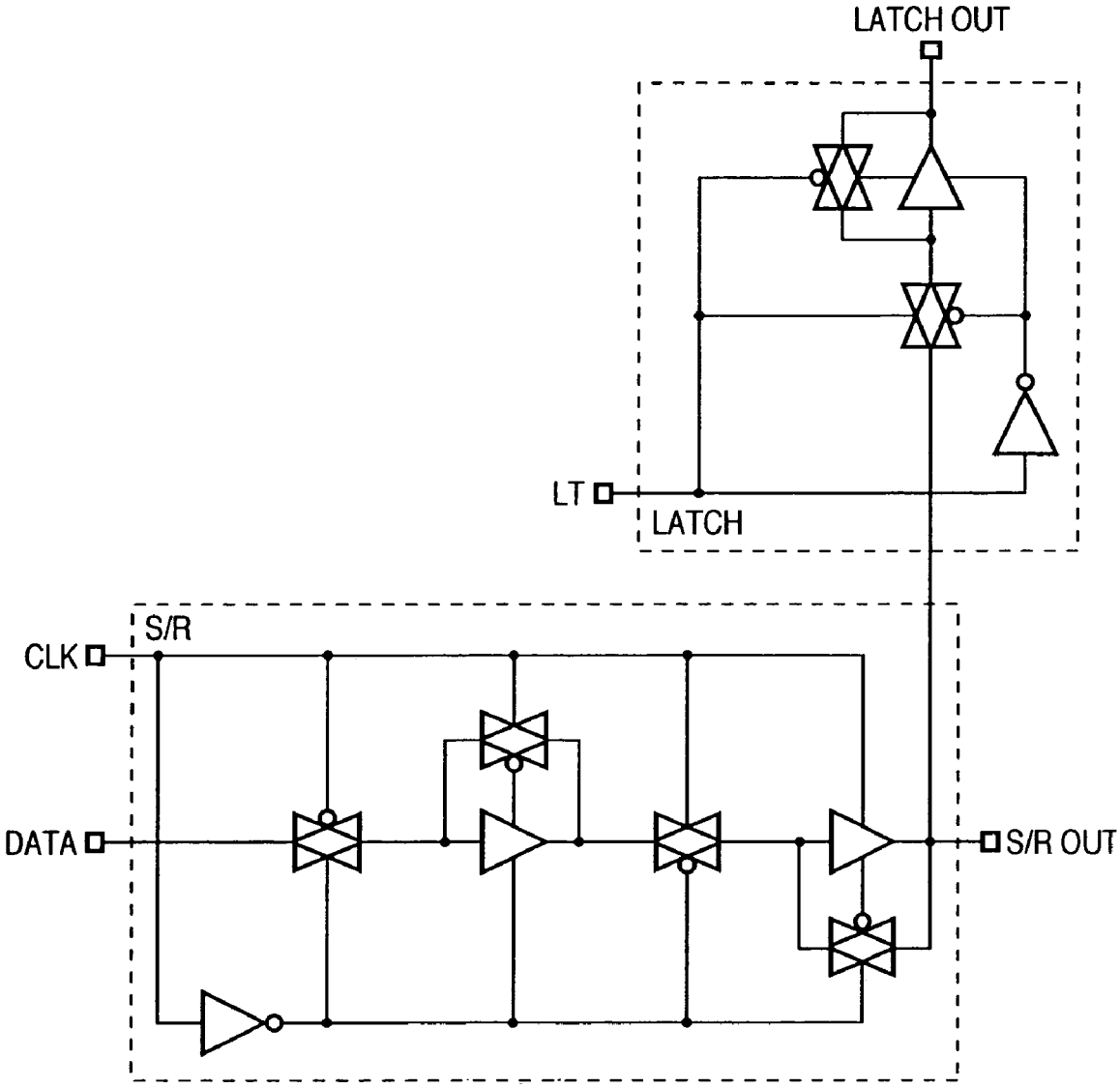
FIG. 15 is a circuit diagram showing an example of a shift register and latch circuit for one bit.

FIG. 15 shows a concrete example of the circuit configuration of the 1-bit shift register+latch circuit 106 in FIG. 1.

In this example, the shift register+latch circuit is comprised of an inverter circuit, buffer circuit, and analog switch circuit. The shift register sequentially outputs signals input from a DATA terminal to an S/R OUT terminal in synchronism with the leading edge of a CLK signal. The S/R OUT terminal is connected to the input of the latch circuit. When an EN terminal changes to "High", the S/R OUT signal is output to LT OUT, and when the EN terminal changes to "Low", the LT OUT output is latched.

The operation of the driving circuit in FIG. 1 will be explained with reference to the timing chart of FIG. 2. The timing chart in FIG. 2 corresponds to one sequence (one discharge cycle) during which an arbitrary heater is selected from M×N heaters so as to be able to drive it once, as described above.

M-bit data corresponding to image data are serially transferred as a DATA signal to the shift registers+latch circuits 108 in synchronism with the clock signal CLK. When the latch signal LT changes to "High", the input serial data are latched and output from the shift registers+latch circuits 108. Outputs from the M shift registers+latch circuits 108 correspond to DATAOUT in FIG. 2, and an arbitrary data line corresponding to image data among M output lines changes to "High".

Similarly, an X-bit block control signal is also serially transferred to the shift register+latch circuit 106 in synchronism with the clock signal CLK. When the latch signal LT changes to "High", the X-bit block control signal is held by the decoder 105. The output timing from the decoder 105 to the block selection line 107 corresponds to a BE timing in FIG. 8. The X-bit block control signal selects one of N outputs from the output lines 107, and the selected output changes to "High".

Of M driving circuits commonly connected to one block selection line 107, an arbitrary heater for which DATAOUT changes to "High" is selected by the AND circuit 104. A current I flows through the selected heater in accordance with an HE signal, driving the heater.

This operation is sequentially repeated N times. M×N heaters are driven for M heaters N times in time division, and all the heaters can be selected. In supplying M data in time division, N driving operations may be performed separately for even- and odd-numbered heaters. This operation also falls within the scope of N-time data driving.

Figure 2:
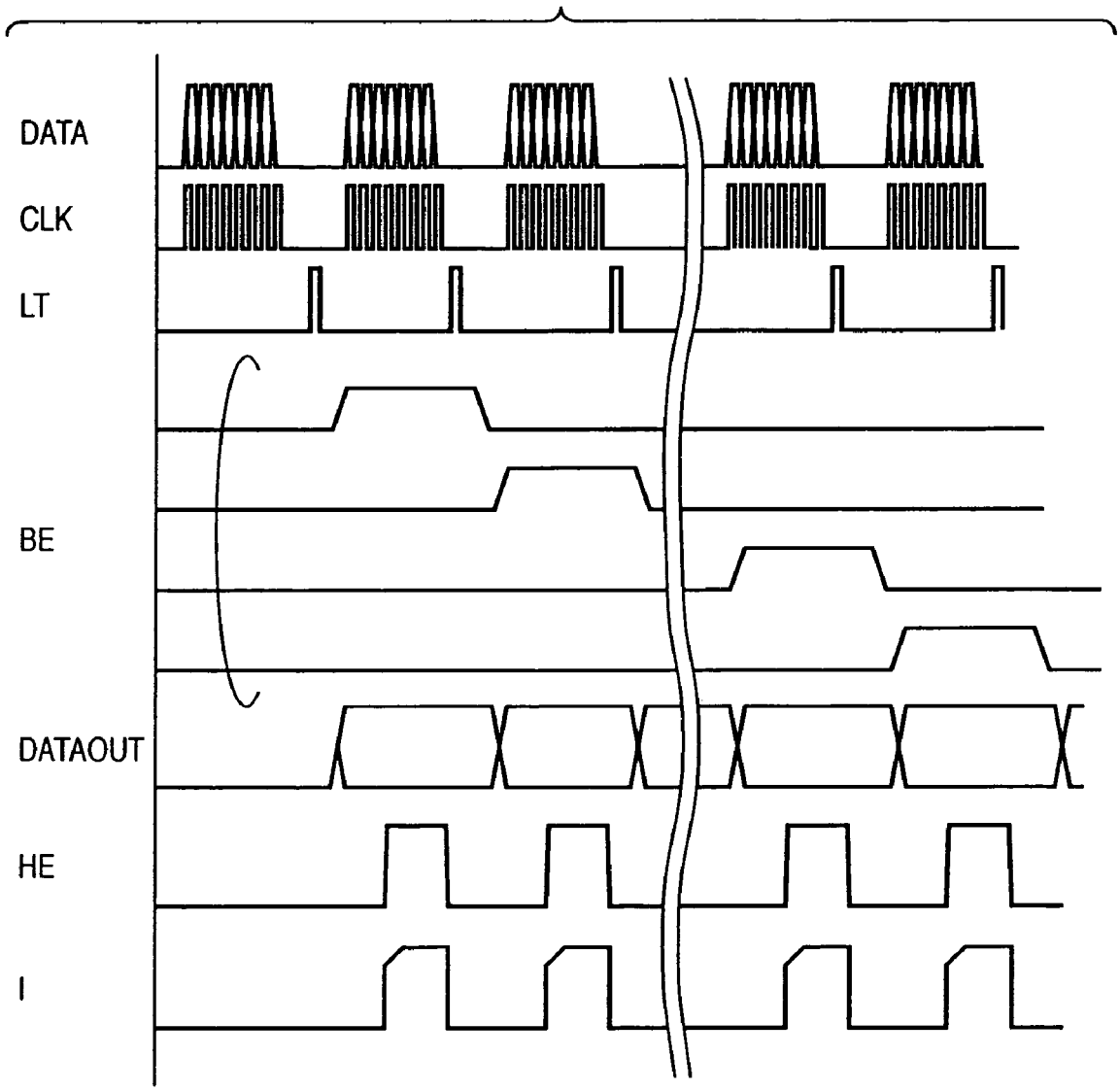
FIG. 2 is a timing chart showing the state of the circuit in FIG. 1.
Figure 7:
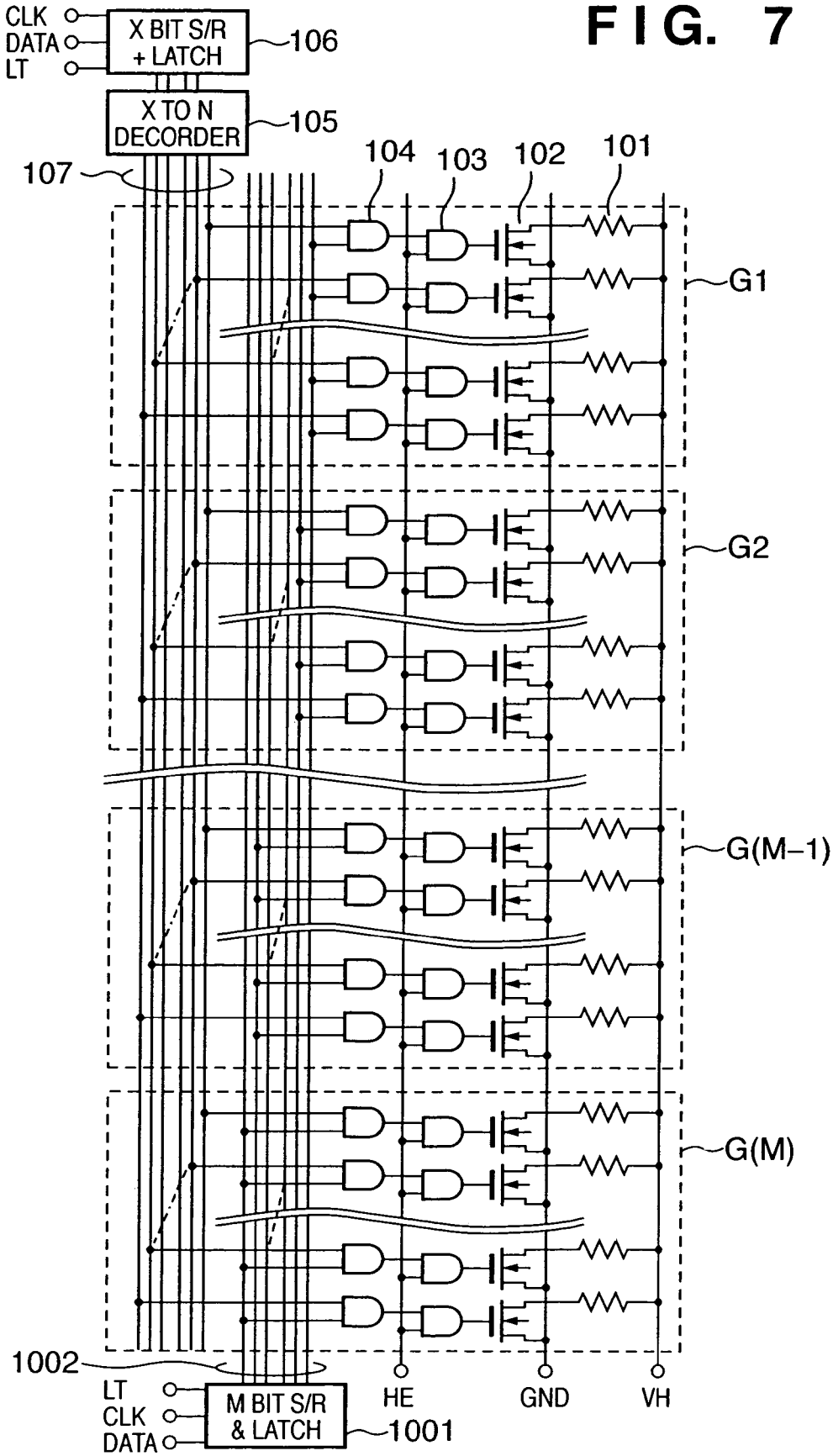
FIG. 7 is a circuit diagram showing a conventional printhead.
Figure 8:
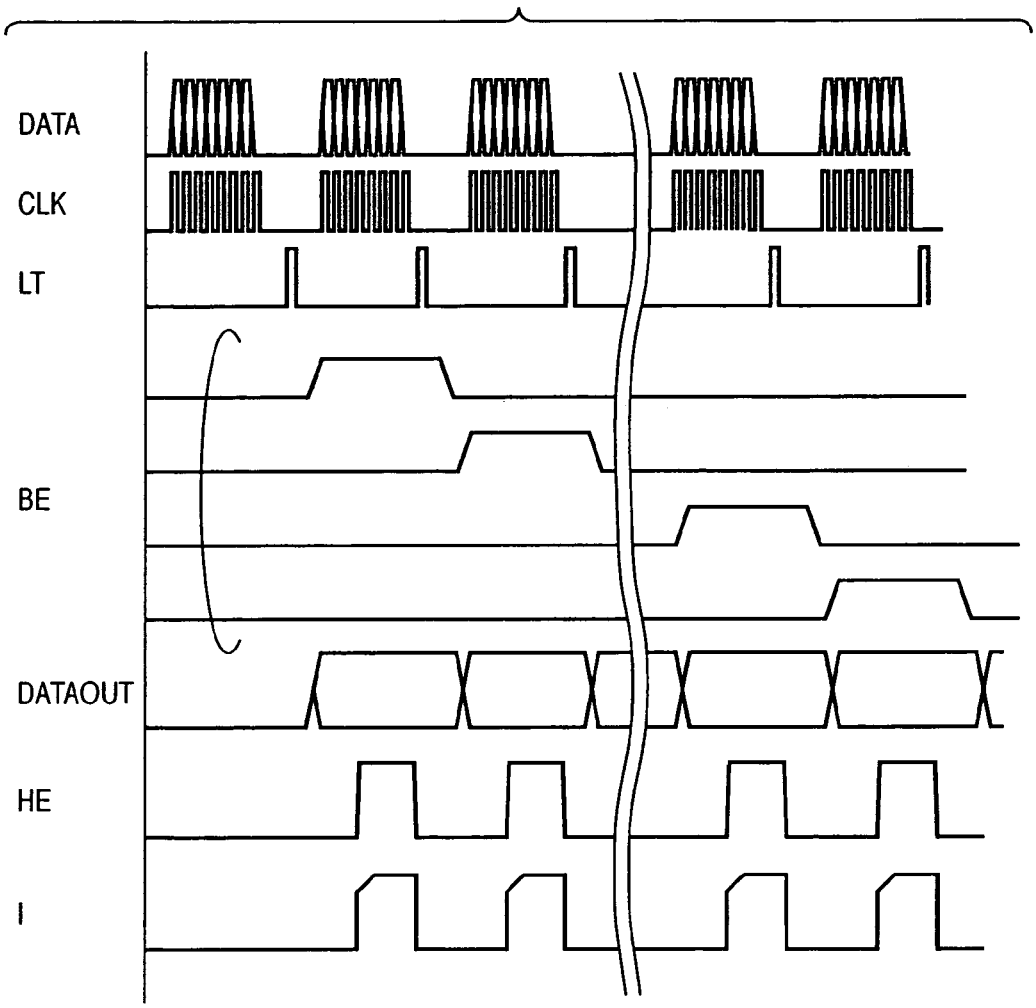
FIG. 8 is a timing chart showing the states of signals in the circuit of FIG. 7.

Logical operation of the circuit described with reference to FIGS. 1 and 2 is the same as that described as the prior art with reference to FIGS. 7 and 8. The circuit configuration of the first embodiment is implemented by replacing the M-bit shift register+latch circuit 1001 in FIG. 7 with the M 1-bit shift registers+latch circuits 108, and logical operation is the same as the conventional one.

Figure 3:
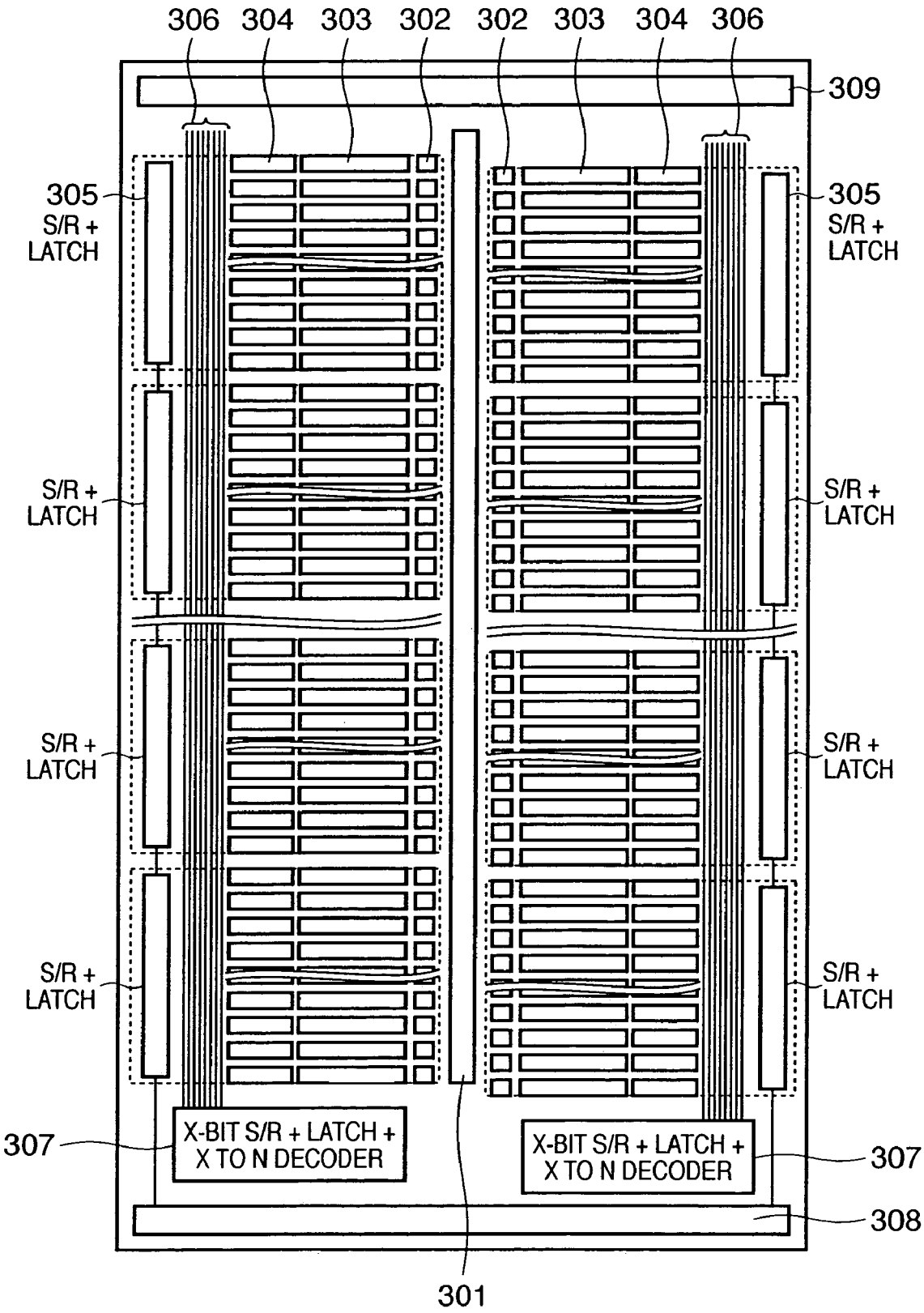
FIG. 3 is a view showing an example of a layout of the circuit in FIG. 1 on an element board.

FIG. 3 shows an example of an actual layout of the circuit in FIG. 1 on an element board. In the layout shown in FIG. 3, heater groups 302 each having M×N heaters are symmetrically laid out in two arrays on both longitudinal sides of elongated ink supply port 301.

In FIG. 3, on both side of the ink supply port provided in the middle of the element board, heater groups 302, transistors 303, AND circuits 304, block selection lines 306 and shift register+latch circuit 305 are arranged in turn along the longer sides of the element board, respectively.

Pad portions 308 and 309 for electrical connection to the apparatus main body are laid out on the two sides (short sides) in a direction crossing to the array direction of the heater group 302 on the element board. Shift registers+latches+decoder circuits 307 are laid out at one of intervals between the pad portions, and driver transistors and driving circuit groups 303 and 304. The pad portions 308 and 309 represent a plurality of pads collectively. Block selection lines 306 each formed from N block selection lines running from a corresponding shift register+latch circuit+decoder circuit 307 are laid out in a direction (in this case, parallel) along the array of the heater group 302.

The correspondence between building components in the circuit diagram of FIG. 1 and regions in the layout of FIG. 3 will be explained. The heaters 101 are formed in the region 302; the transistors 102, in the region 303; the AND circuits 103 and 104, in the region 304; the block selection lines 107, in the region 306; the shift register+latch circuit 106 and decoder 105, in the region 307; and the shift registers+latch circuits 108, in a region 305.

The 1-bit shift registers+latch circuits 108 in FIG. 1 are distributively laid out in the circuit regions of the groups G1 to GM in correspondence with the respective groups, and a total of M shift registers+latch circuits 108 are arranged. Each of the groups G1 to GM is formed from N heaters and a driving circuit including transistors, AND circuits, and a shift register+latch circuit.

In general, it is most efficient in terms of the resistance of a wiring line which connects elements and the occupied area to align heaters, transistors, and AND circuits at the same pitch. Assuming that the heater array pitch and the driving circuit array pitch are equal to each other, the length of each group along the heater array direction is calculated by multiplying the heater array pitch by N.

For example, when the heater array pitch is 42.3 μm (corresponding to 600 dpi) and the number N of heaters which form a group is 16, the length of each group in the heater array direction is about 677 μm. In this case, the long-side length of the region 305 in which the 1-bit shift register+latch circuit 108 corresponding to each group is formed is 677 μm. The length of the region 305 along the short side of the element board in which the shift register+latch circuit 108 is formed can be greatly shortened.

Figure 9:
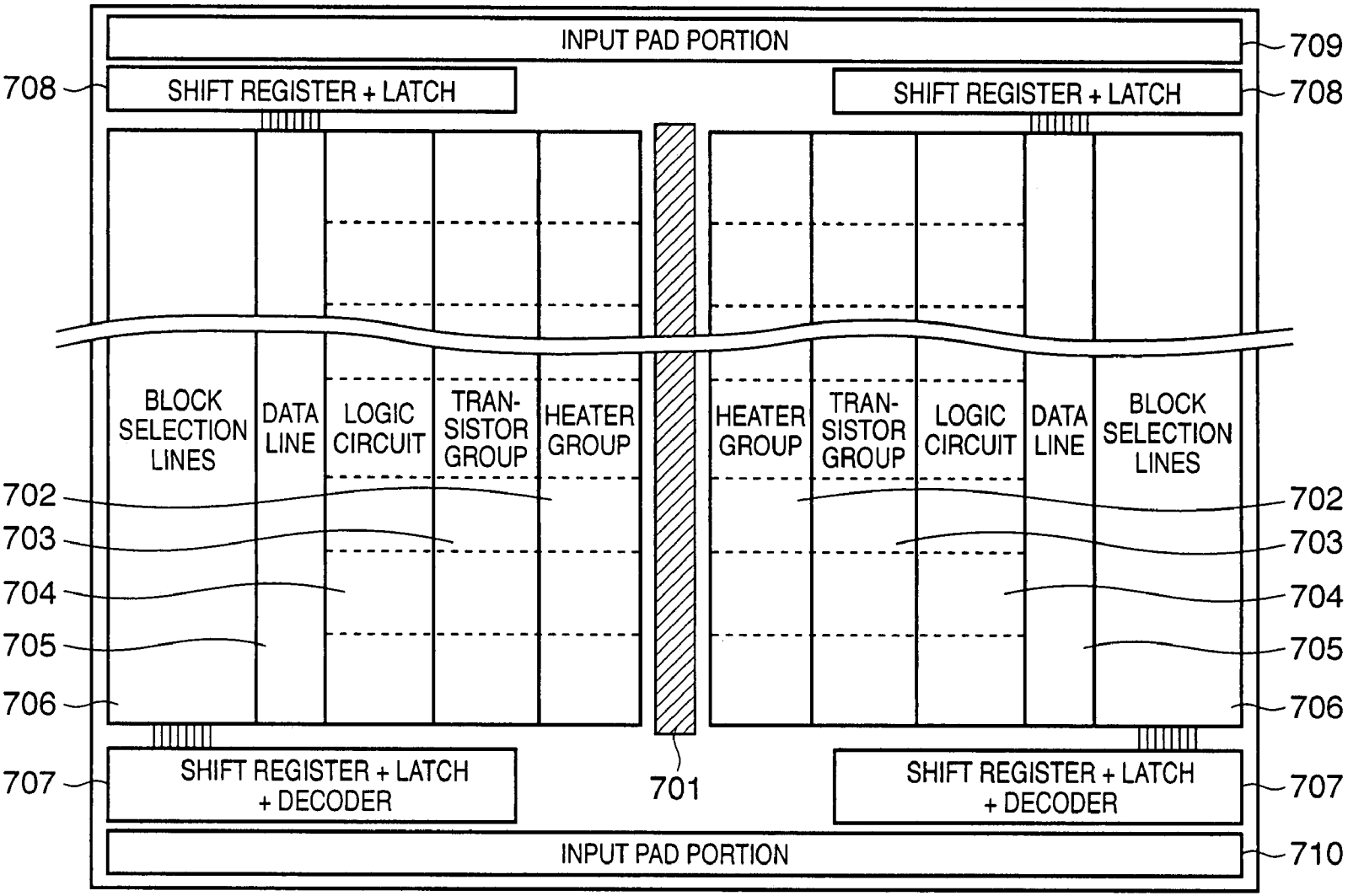
FIG. 9 is a view showing the layout of the circuit in FIG. 7 on an element board.

In the prior art, the short side of the data line wiring region 705 in FIG. 9 becomes longer as the number of groups increases along with an increase in the number of heaters. To the contrary, the first embodiment adopts the layout as shown in FIG. 3, and thus only the long-side length of the element board is increased without changing the short-side length of each group even if the number of groups increases.

Second Embodiment

The second embodiment of a printhead according to the present invention will be described. In the following description, a description of the same parts as those in the first embodiment will be omitted, and characteristic parts of the second embodiment will be mainly explained.

The circuit of the printhead according to the second embodiment is the same as that according to the first embodiment shown in FIG. 1. The second embodiment is different from the first embodiment in the layout on the element board.

Figure 4:
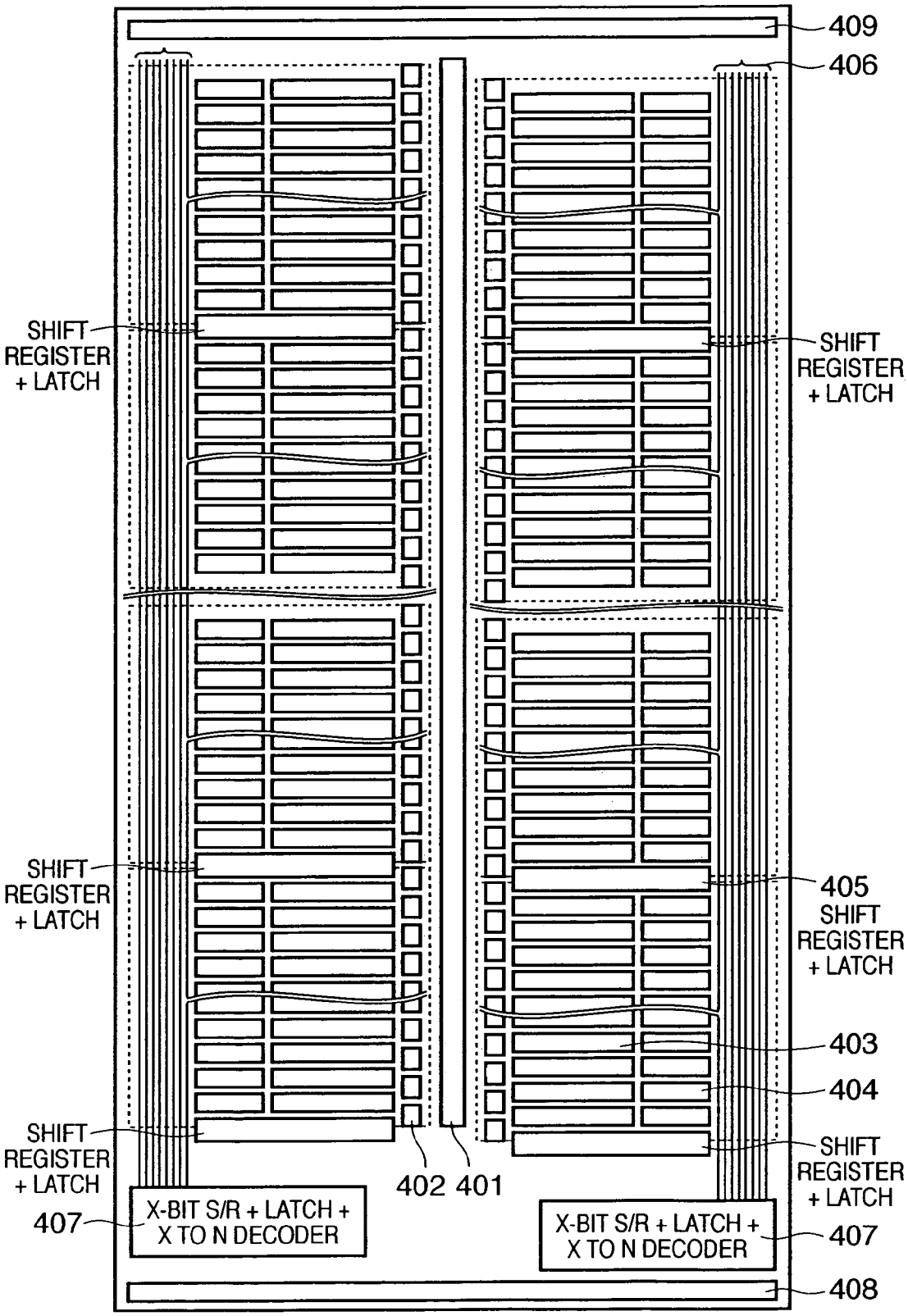
FIG. 4 is a view showing another example of the layout of the circuit in FIG. 1 on an element board.

FIG. 4 is a view showing an actual layout on an element board according to the second embodiment, similar to FIG. 3. In the layout of the first embodiment shown in FIG. 3, the length in the heater array direction in each group and the length in the long-side direction of a corresponding driving circuit are set equal to each other. In the layout of the second embodiment, the length in the long-side direction of a corresponding driving circuit can be set smaller than the length in the heater array direction in each group.

In FIG. 4, on both sides of an ink supply port 401 arranged in the middle of the element board along the longitudinal direction, heater group 402 including M×N heaters, transistors 403, AND circuits 404, block selection lines 406 are arranged from the ink supply port to the outside in turn, along the longitudinal sides of the element board, respectively. Pad portions 408 and 409 for electrical connection to the apparatus main body are laid out on two sides (short sides) in a direction crossing to the array direction of a heater group 402 on the element board. Shift registers+latches+decoder circuits 407 are laid out at one of intervals between the pad portions, and driving transistors and driving circuit groups 403 and 404. Block selection lines 406 each formed from N block selection lines running from a corresponding shift register+latch circuit+decoder circuit 407 are laid out parallel to the heater group 402.

The correspondence between building components in the circuit diagram of FIG. 1 and regions in the layout of FIG. 4 will be explained. Heaters 101 are formed in the region 402; transistors 102, in the region 403; AND circuits 103 and 104, in the region 404; block selection lines 107, in the region 406; a shift register+latch circuit 106 and decoder 105, in the region 407; and shift registers+latch circuits 108, in a region 405.

In the second embodiment, the length in the long-side direction of the driving circuit is designed smaller than the length in the heater array direction in each group. The remaining region is ensured in a direction (short-side direction) crossing to the heater array direction as the region 405 for forming the shift register+latch circuit 108. In FIG. 4, the shift register+latch circuit 405 in arranged in the perpendicular direction with respect to the arrangement in FIG. 3. In detail, the shift register+latch circuit 405 is so arranged that the longer side of the shift register+latch circuit is parallel to the shorter side of the element board, and that the shift register+latch circuit resides between different groups of the transistors 403 and AND circuits 404.

With this layout, the area of a region for forming each group is kept constant regardless of the number of groups, and the short-side length of the element board does not increase even if the number of groups increases upon an increase in the number of heaters.

Third Embodiment

The third embodiment of a printhead according to the present invention will be described. In the following description, a description of the same parts as those in the first and second embodiments will be omitted, and characteristic parts of the third embodiment will be mainly explained.

Figure 5:
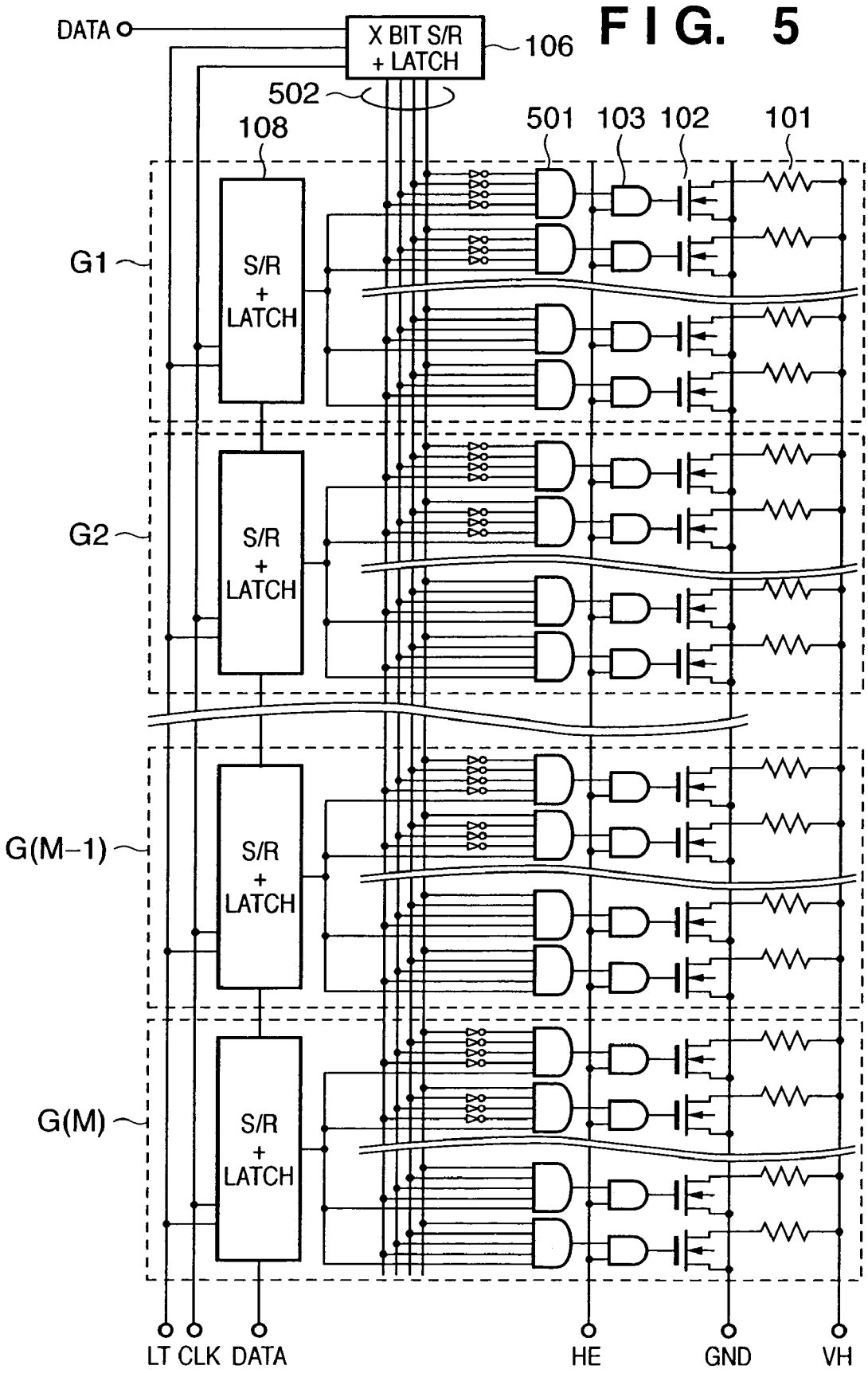
FIG. 5 is a circuit diagram showing a printhead according to the third embodiment of the present invention.

FIG. 5 is a circuit diagram showing the third embodiment in which decoder circuits 501 are arranged in correspondence with respective heaters. In the first embodiment of FIG. 1, the X to N decoder circuit 105 is arranged commonly to M groups each having N heaters. N block selection lines are connected to AND circuits in each group in accordance with an output from the decoder circuit 105, and an arbitrary heater within the group is selected. To the contrary, in FIG. 5, X block control lines 502 are connected to the decoder circuits 501 arranged for respective heaters within each group in accordance with an output from an X-bit shift register 106, and a heater within the group is selected. Logical operation regarding heater selection in FIG. 5 is the same as that in the first embodiment in FIG. 1.

The number of block control lines 502 for selecting a heater within a group is X in FIG. 5, whereas the number of block selection lines 107 is N in FIG. 1. For example, when the number of heaters within a group is 16, the number of block selection lines 107 is 16 in FIG. 1, but the number of block control lines 502 is four in FIG. 5. For this reason, the configuration of FIG. 5 can greatly reduce the number of wiring lines associated with heater selection. The effect of decreasing the number of wiring lines becomes more prominent especially when the number of heaters within a group increases.

Figure 6:
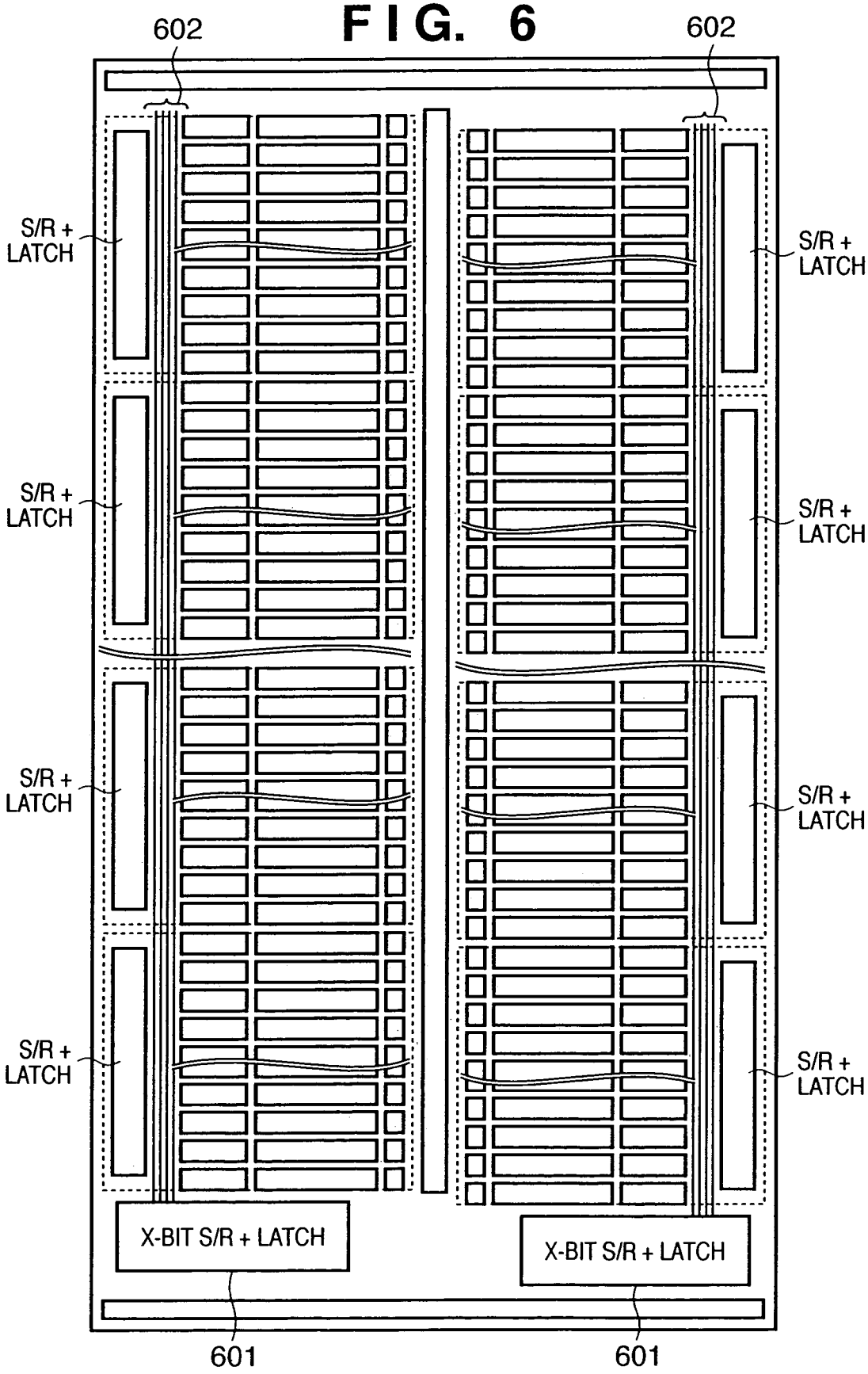
FIG. 6 is a view showing an example of a layout of the circuit in FIG. 5 on an element board.

FIG. 6 is a view showing an example of an actual layout of the circuit in FIG. 5 on an element board. The number of decoder wiring lines 306 in FIG. 3 is N, whereas the number of block control lines 602 of each X-bit shift register 601 is X. In the wiring area, the layout area regarding to the selection of the block can be reduced.

In the above description, a 1-bit shift register+latch circuit is arranged for each group. The unit of the group is determined by the premise that the number of simultaneously driven heaters is one.

Fourth Embodiment

Figure 16:
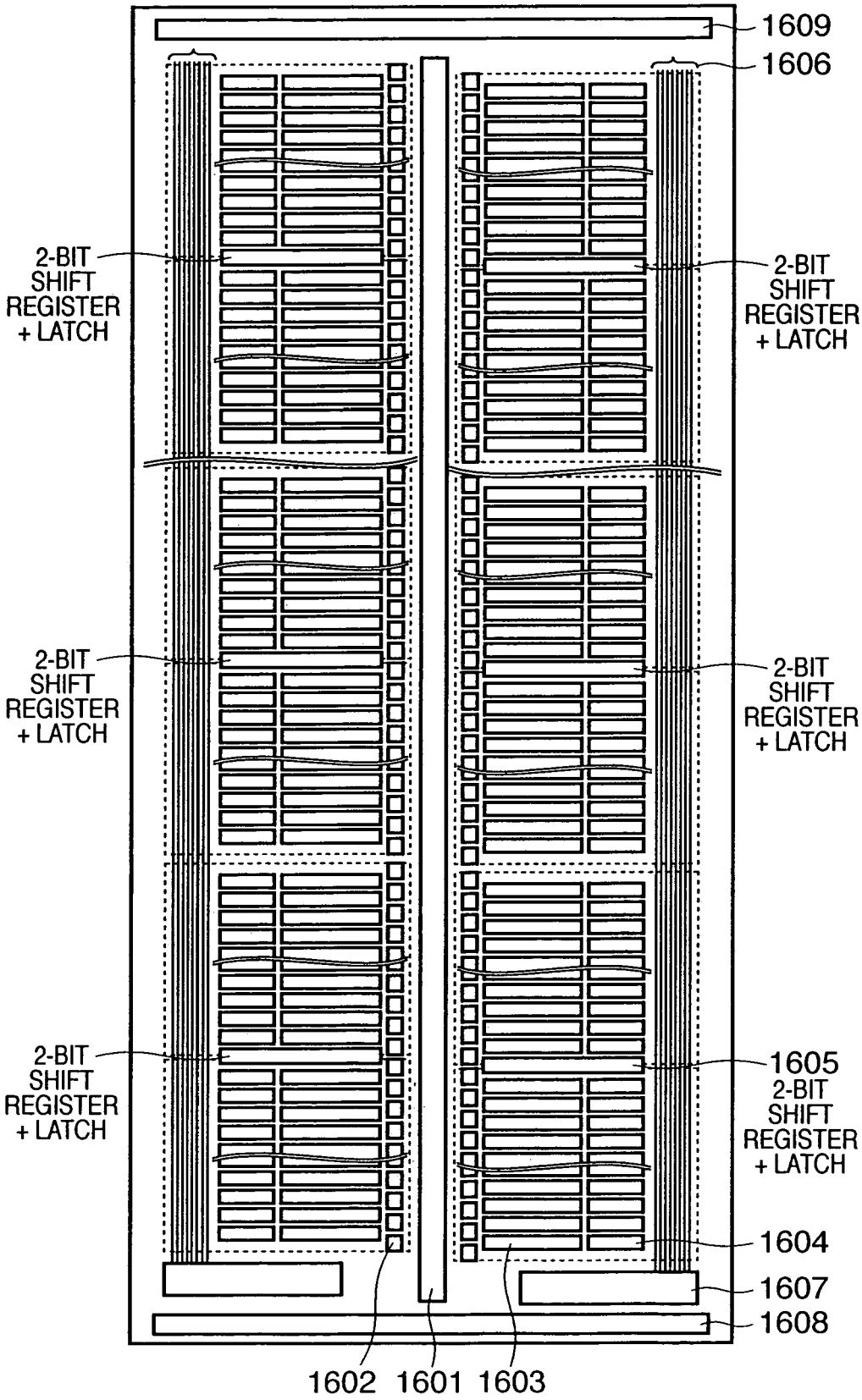
FIG. 16 is a view showing an example of a layout on an element board according to the fourth embodiment of the present invention.

FIG. 16 shows an actual layout of the forth embodiment of the present invention. In FIG. 16, a 2-bit shift register and 2-bit latch are interposed between groups.

In FIG. 16, portions 1601 to 1609 correspond to the portions 401 to 409 in FIG. 4 described in the second embodiment. The number of bits of each shift register+latch circuit 1605 is 2. The shift register+latch 1605 interposed between two, upper and lower groups adjacent to it has 2-bit data, and can supply image data to the two, upper and lower groups adjacent to the shift register+latch circuit 1605.

In the second embodiment of FIG. 4, the shift register+latch circuit is arranged on one side of the driving circuit of each group. In the fourth embodiment, the shift register+latch circuit is arranged at once between two, upper and lower groups adjacent to it in FIG. 16. Except for this, electrical operation is the same as that in the second embodiment. The area occupied by the 2-bit shift register+latch circuit is much larger than the layout area of the 1-bit shift register+latch circuit. However, some layout portions can be commonly used by combining power supply wiring lines and the like for 2 bits. Hence, the area can be suppressed two times or less the area of the 1-bit circuit, increasing the area efficiency.

Fifth Embodiment

In the circuit configuration as described in the first embodiment (FIG. 3) in which one shift register+latch circuit is arranged near a corresponding block, the same width as a width used to arrange N heaters can be used for laying out the shift register+latch circuit.

For a large time division number N, a large layout area can be ensured for the shift register+latch circuit. For a small time division number N, the area becomes smaller.

Figure 17:
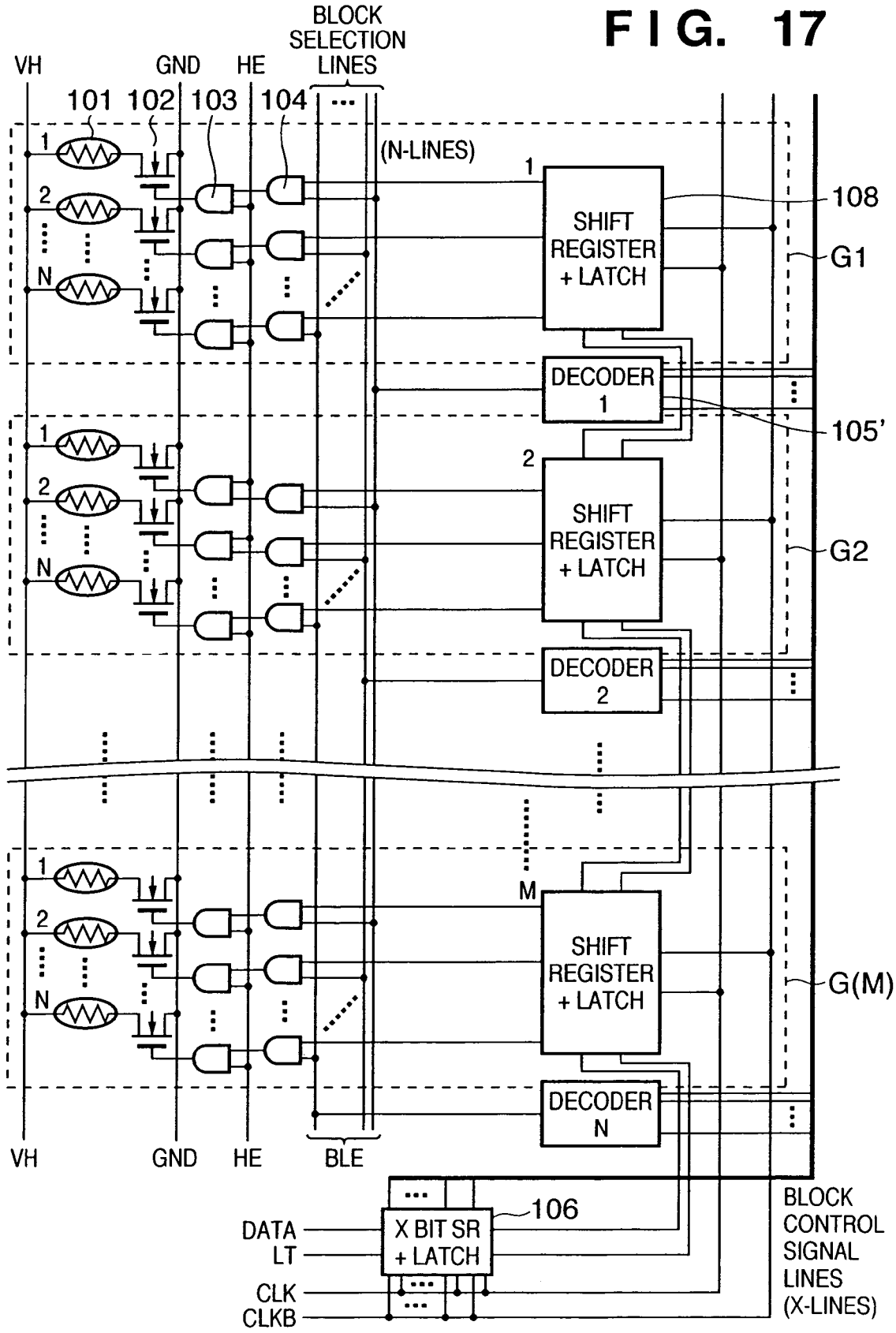
FIG. 17 is a circuit diagram according to the fifth embodiment of the present invention.
Figure 18:
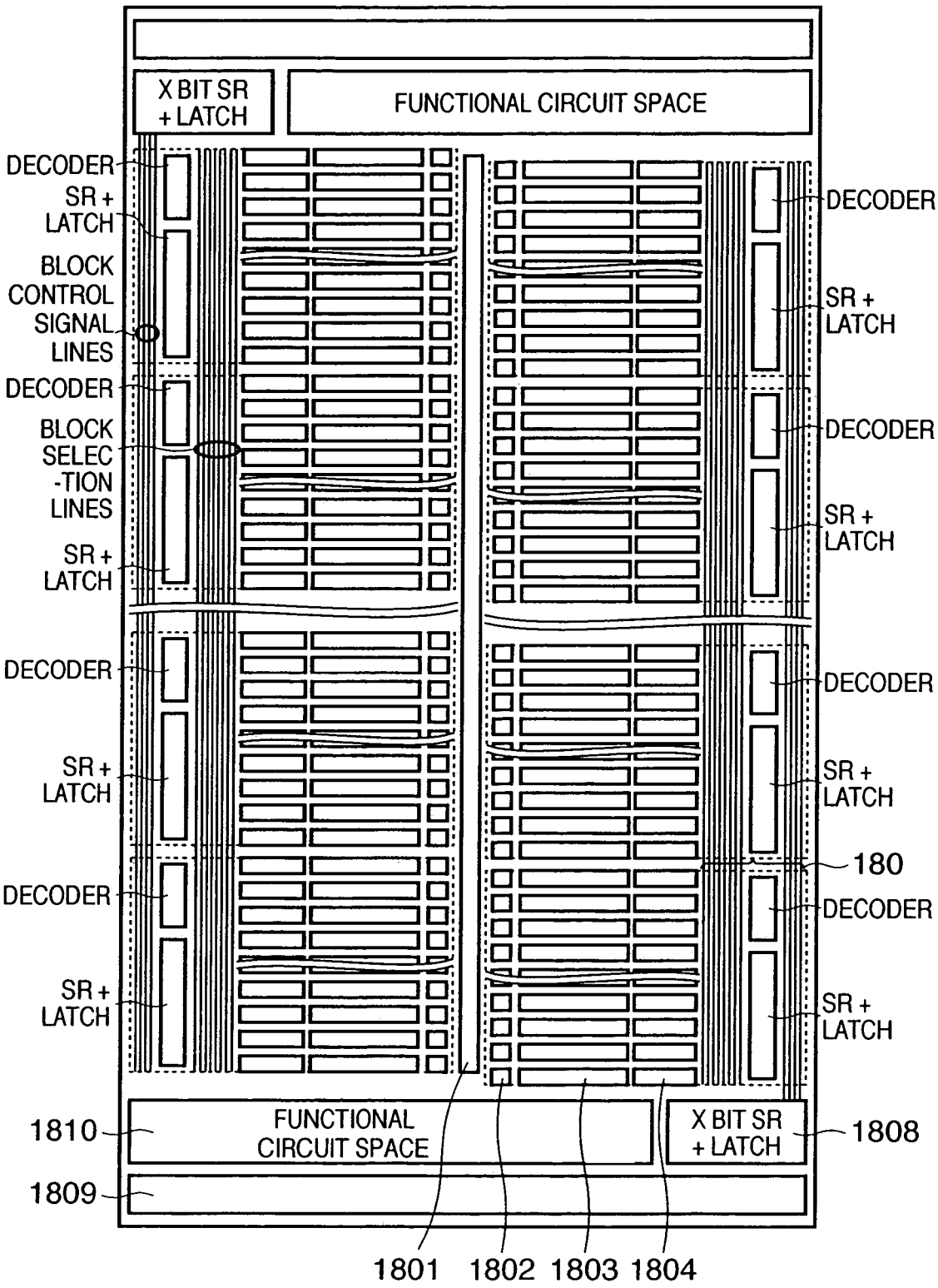
FIG. 18 is a view showing an example of a layout on an element board according to the fifth embodiment of the present invention.

The fifth embodiment further increases the layout efficiency in consideration of this relationship. FIG. 17 is a circuit diagram showing a circuit configuration according to the fifth embodiment. FIG. 18 is a view showing an example of an actual layout on an element board according to the fifth embodiment.

In this embodiment, as shown in FIG. 18, on the both sides of an ink supply port arranged in the middle of the element board along the longitudinal direction, two heater arrays including M×N heaters are arranged symmetrically, and driver transistors, logic circuits, shift register+latch+decoder circuits and wiring lines corresponding to these circuits are arranged in parallel to the array of heaters along the longitudinal direction.

In FIG. 17, reference numerals 101 denote heaters; 102, driver transistors; 103 and 104, logic circuits; 105', decoders; 106, an X-bit shift register+latch circuit; and 108, shift registers+latch circuits corresponding to respective groups. The correspondence between the respective portions in FIG. 17 and FIG. 18 showing the layout example will be explained. An ink supply port is laid out in a region 1801; the heaters 101, in a region 1802; the driver transistors 102, in a region 1803; the logic circuits 103 and 104, in a region 1804; the shift registers+latch circuits 108 corresponding to respective groups, the decoders 105', and wiring lines for block selection signals and decoders, in a region 1805; and the shift register+latch circuit 106, in a region 1808.

In the first embodiment, the shift registers+latch circuits are laid out parallel to the heater array direction near groups corresponding to the respective shift registers. The fifth embodiment employs the circuit configuration as shown in FIG. 17, and the decoders 105' which have conventionally been laid out at the end of an element board are interposed between the shift registers+latch circuits 108 of the respective groups in parallel to the direction of the heater array, as shown in FIG. 18.

The first M-bit DATA is input to the M-bit shift register 108 in synchronism with CLK, and then supplied and latched in the logic circuits 103 and 104 of an adjacent group at a timing at which the LT signal changes to "High".

The remaining X-bit DATA is input to the X-bit shift register 106 located at the end, latched at a timing at which the LT signal changes to "High", and supplied to the N decoders 105' interposed between the shift registers.

Outputs from one of N decoders 105' corresponds to one of N block selection (BE) lines, respectively. In N decoders, only one decoder outputs "High" signal at one time, and only one block selection line becomes "High".

For a large time division number N, the width of each group becomes large, and a large layout area 1805 can be ensured for the shift register+latch circuit 108, as described above. In the fifth embodiment, therefore, the decoder 105' is arranged in the remaining space, as shown in FIG. 18.

With this circuit configuration shown in FIG. 17, the decoders can be laid out in a line in addition to the shift registers and latches, as shown in FIG. 18. This layout can produce on the element board a space 1810 for laying out, e.g., a functional circuit for example, for stabilizing a voltage or current.

However, when the time division number N is small, the shift register layout area 1805 cannot be kept large. The relationship between the division number and the shift register+latch circuit layout area 1805 will be examined.

For example, when 256 heaters are laid out at a pitch of 600 dpi and the time division number N is 16, the number M of groups is 16, and the width of one group in the longitudinal direction of the element board is about 0.68 mm. However, when the time division number N is as half as 8, the number of groups is 32, and the width of one group is halved to about 0.34 mm.

However, the time division number N=8 means that the number of necessary decoders is also 8 which is half the number of decoders for the time division number=16. Only one decoder suffices to be inserted for four shift registers, and decoders can be laid out within the layout area 1805 even at a small width.

The layout efficiency greatly changes depending on the time division number N, the number M of groups, the heater density, the number of heaters, and the layout area ratio of the shift register to the decoder.

Figure 20:
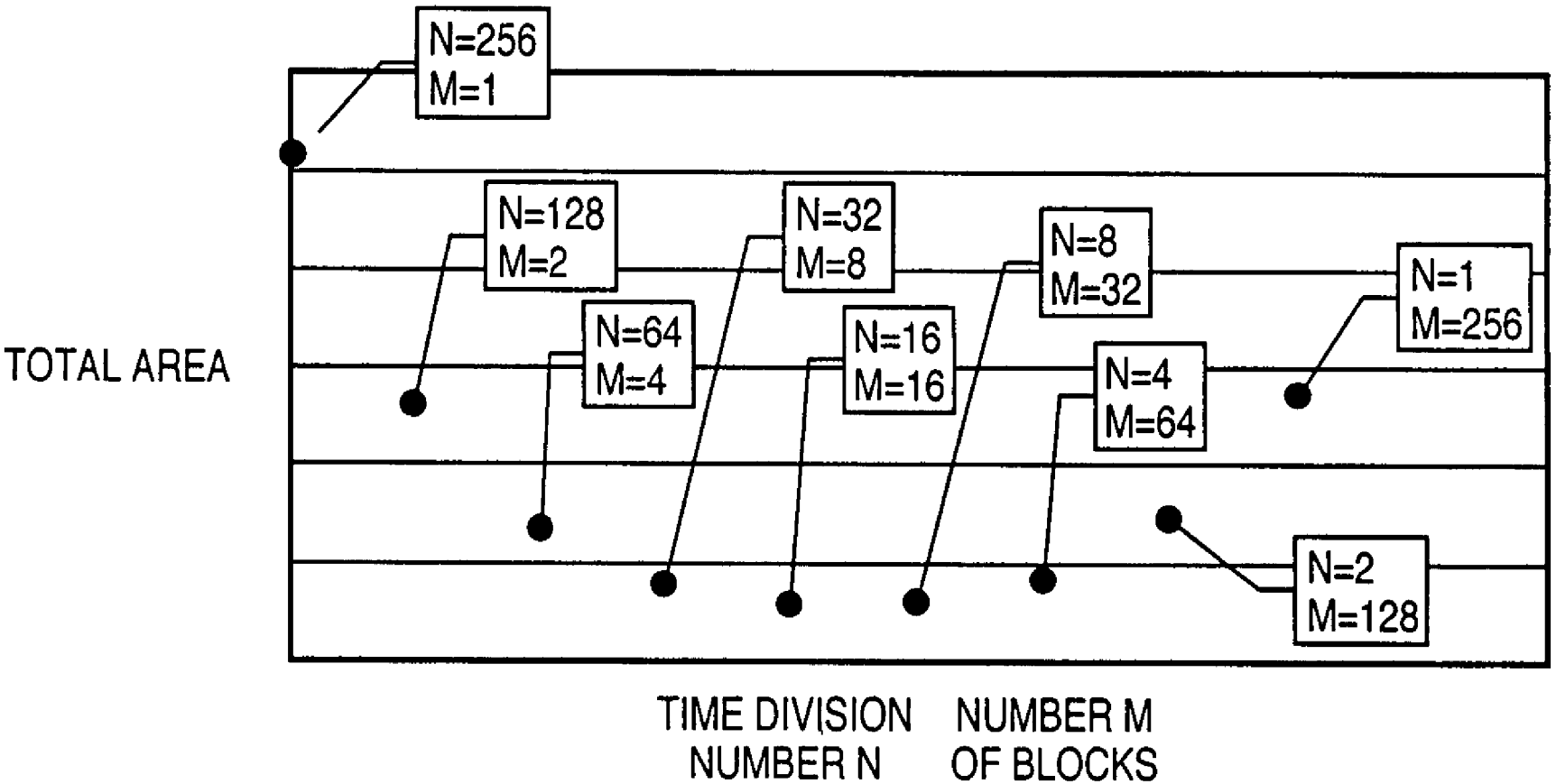
FIG. 20 is a graph showing the relation ships among N, M and the total area in FIG. 19.

FIG. 19 is a table showing the relationship between the number of shift registers (SRs), the number of decoders (DECs), and the total area (ratio) when the number of heaters is 256, the pitch is 600 dpi, the layout area ratio of the shift register to the decoder is 2:1, and the time division number N and the number M of groups are changed. FIG. 20 is a graph showing the relationship between N, M, and the total area in FIG. 19. As is apparent from FIGS. 19 and 20, the time division number N=16 and the number M of groups=16 exhibit the highest layout efficiency.

In the conventional circuit configuration and layout, in order to design a long element board by increasing the number heaters, the number of bits of a shift register arranged at the end of an element board, the number of decoders, and the number of wiring lines must be increased, and the short-side size of the element board must also be increased. In the circuit configuration and layout of the fifth embodiment, however, even if the number of heaters increases and the element board becomes long, only the number of circuit groups suffices to be increased along the long side without changing the number of wiring lines and widening the element board along the short side. Compared to the conventional circuit configuration and layout, the circuit can be easily efficiently laid out, reducing the cost of the element board.

In the layout of the element board according to the fifth embodiment, as shown in FIG. 18, all circuits such as shift registers, decoders, and latches which have conventionally been arranged at the end of an element board are arranged along the heater array, and a wide space can be obtained at the end of the substrate. By laying out a functional circuit in this space, a more advanced function can be implemented on the same element board size as the conventional one.

As described above, according to the fifth embodiment, a wide space can be ensured at the end of a substrate even on a substrate having a large number of heaters, similar to a substrate having a small number of heaters. An additional functional circuit and heater driving circuit can be formed in the ensured space, a circuit formed on the element board can attain a more advanced function, and the cost can be reduced.

In FIG. 17, the circuit constitutes the decoder is arranged dispersively, as decoder 1, decoder 2, . . . , and so on, the configuration of these dispersed decoder will be described.

Figure 29:
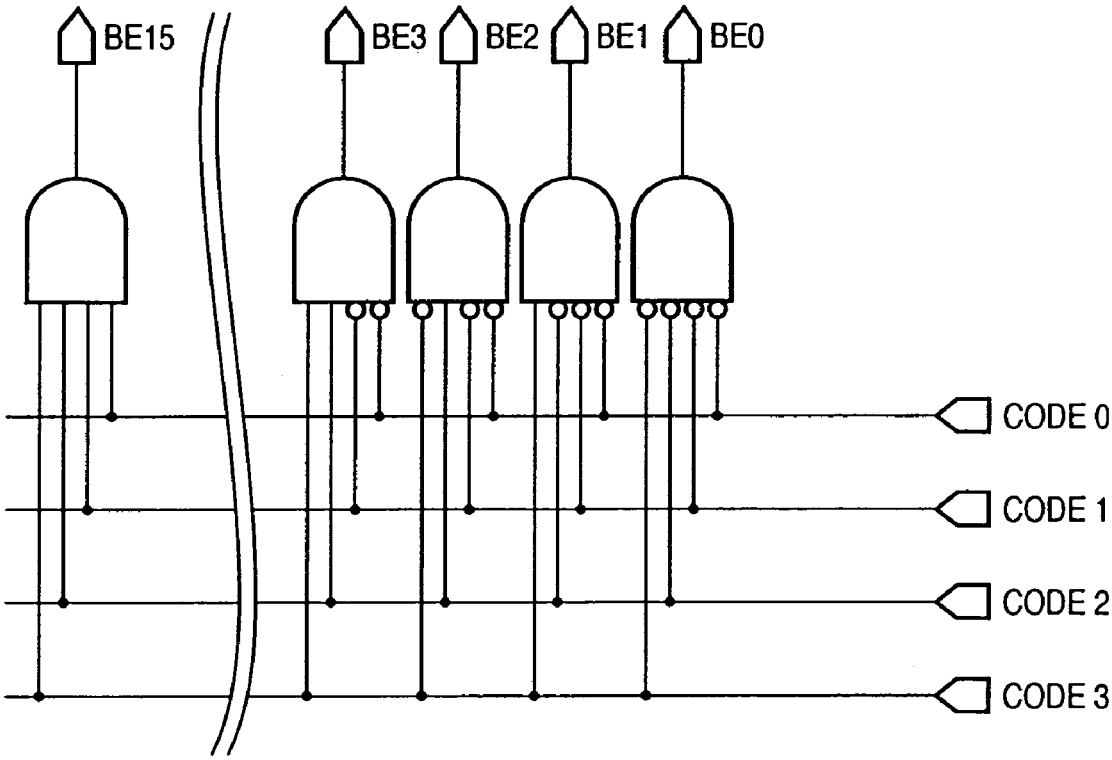
FIG. 29 is a circuit diagram showing an example of a decoder.

FIG. 29 shows a circuit configuration of the decoder, and FIG. 30 shows a truth table for the decoder. In these drawings, 4 to 16 decoder (X=4, N=16) is described as an example of the decoder. The decoder has N (16) AND circuits with X (0-4) inverters connected to their respective input portions. This decoder is arranged in N (16) dispersed decoders in which one unit includes one AND circuit and inverter(s) connected to its input portion(s), adjacent to respective driving circuits of the same group, as shown in FIG. 18. The number of inverters connected to input portions of each of the AND circuit differs for each of AND circuits, and determined in accordance with the truth table shown in FIG. 30. In the truth table shown in FIG. 30, "L" means Low state of the signal and "H" means High state of the signal. As shown, corresponding one of 16 AND circuits outputs High signal with respect to 4-bit of decoder control signals (code 0 to 3) to respective one of the block selection lines.

Figure 31:
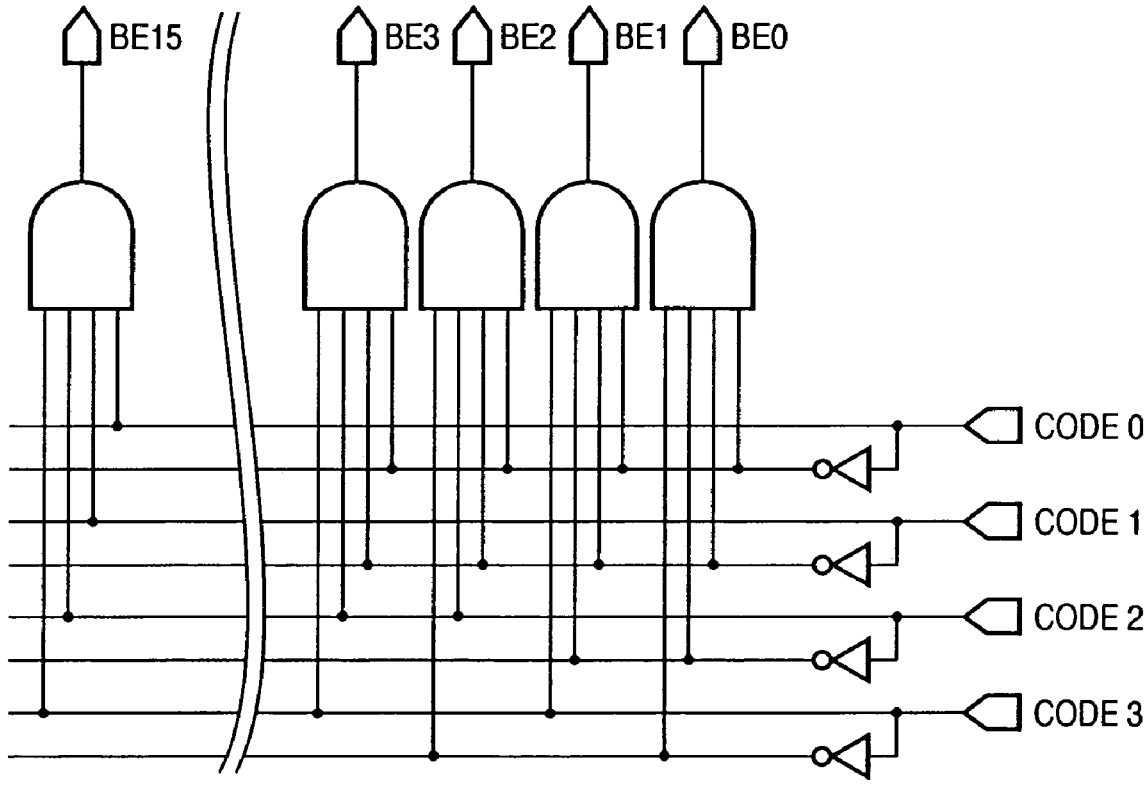
FIG. 31 is a circuit diagram showing another example of a decoder.

Next, another circuit configuration for the decoder will be described with reference to FIG. 31. In FIG. 31, 4 to 16 decoder (X=4, N=16) is described as an example of the decoder. In the configuration shown in FIG. 31, in addition to 4-bit of decoder control signals (code 0 to 3), respective inverted signals are required. These inverted signals are generated by inverters arranged near the outputs of the shift register for respective decoder control signals. As above, the decoder control signals are doubled to 8 signals, and these 8 decoder control signals are connected to 4 inputs of respective AND circuits in accordance with the truth table of FIG. 30. Each of N (16) AND circuits is arranged adjacent to driving circuit in the same group as a circuit constitutes a part of dispersed decoders, as shown in FIG. 18. 4 signal lines within 8 signal lines of the decoder control signals inputted to respective AND circuits are different with each other.

In this configuration, there is no need to provide inverters near respective inputs of AND circuits. That is, as shown in FIG. 17, if the decoder is arranged in dispersion, the number of decoder control signals wiring on the element board is 8 which is double of the number of wiring lines in the configuration of FIG. 29, each dispersed decoder 105' can be configured by AND circuit only. For this reason, this configuration is effective for a layout in which the length of the shorter sides crossing to the direction of the heater array (longitudinal direction of the ink supply port) of the element board would be shortened. Further, in view of area efficiency in whole of the element board, the configuration shown in FIG. 31 is more efficient than the configuration shown in FIG. 29, since the number of inverters is considerably reduced.

Modification to Fifth Embodiment

In the actual layout example shown in FIG. 18, similar to the prior art and the above-described embodiments, driver transistors and logic circuits are laid out in accordance with the heater layout interval. At this time, if the driver transistors and logic circuits can be laid out at an interval smaller than the heater interval, their interval is decreased within each group to ensure a space for newly laying out a circuit.

Figure 21:
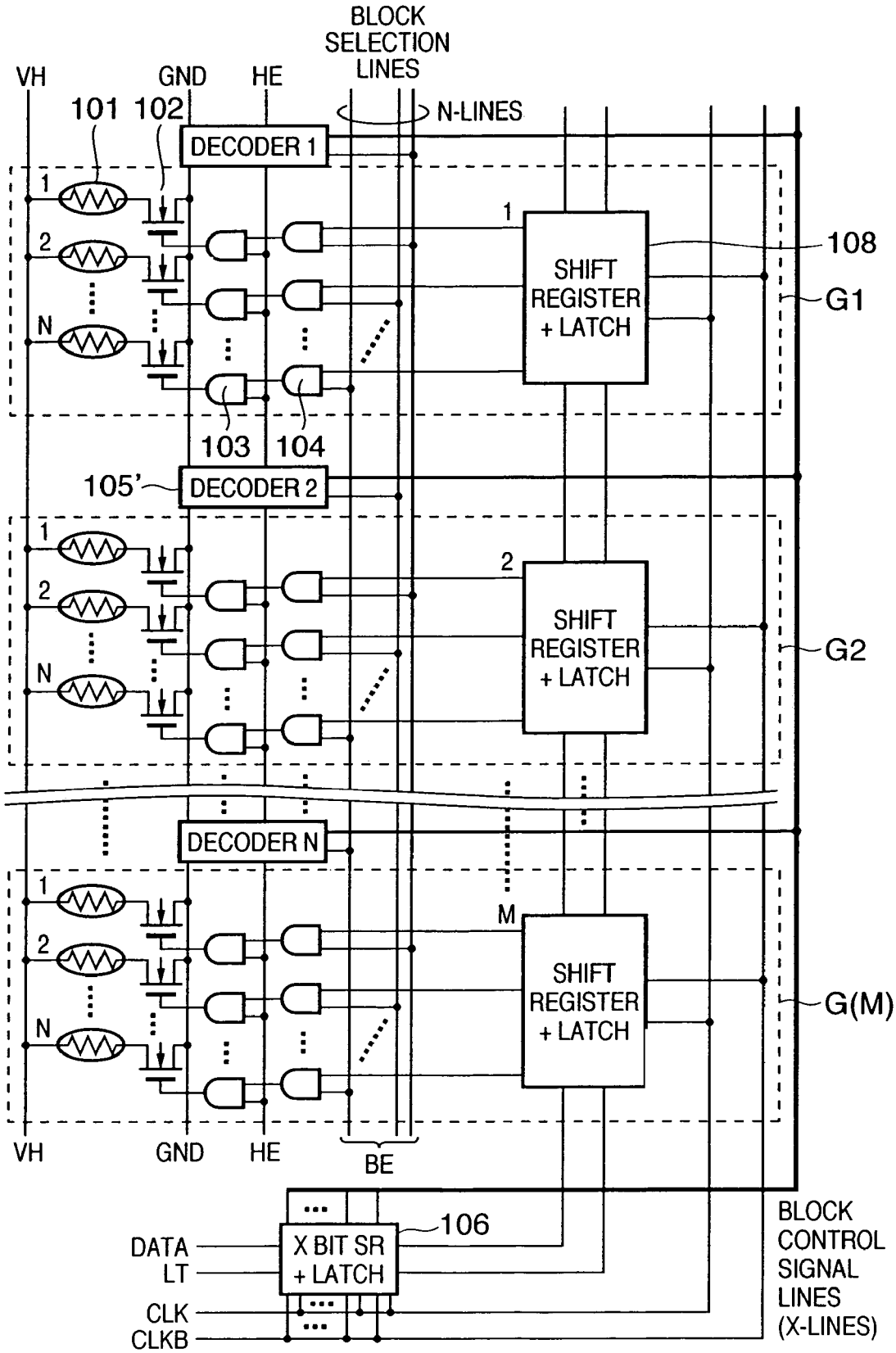
FIG. 21 is a circuit diagram according to a variation of the fifth embodiment.
Figure 22:
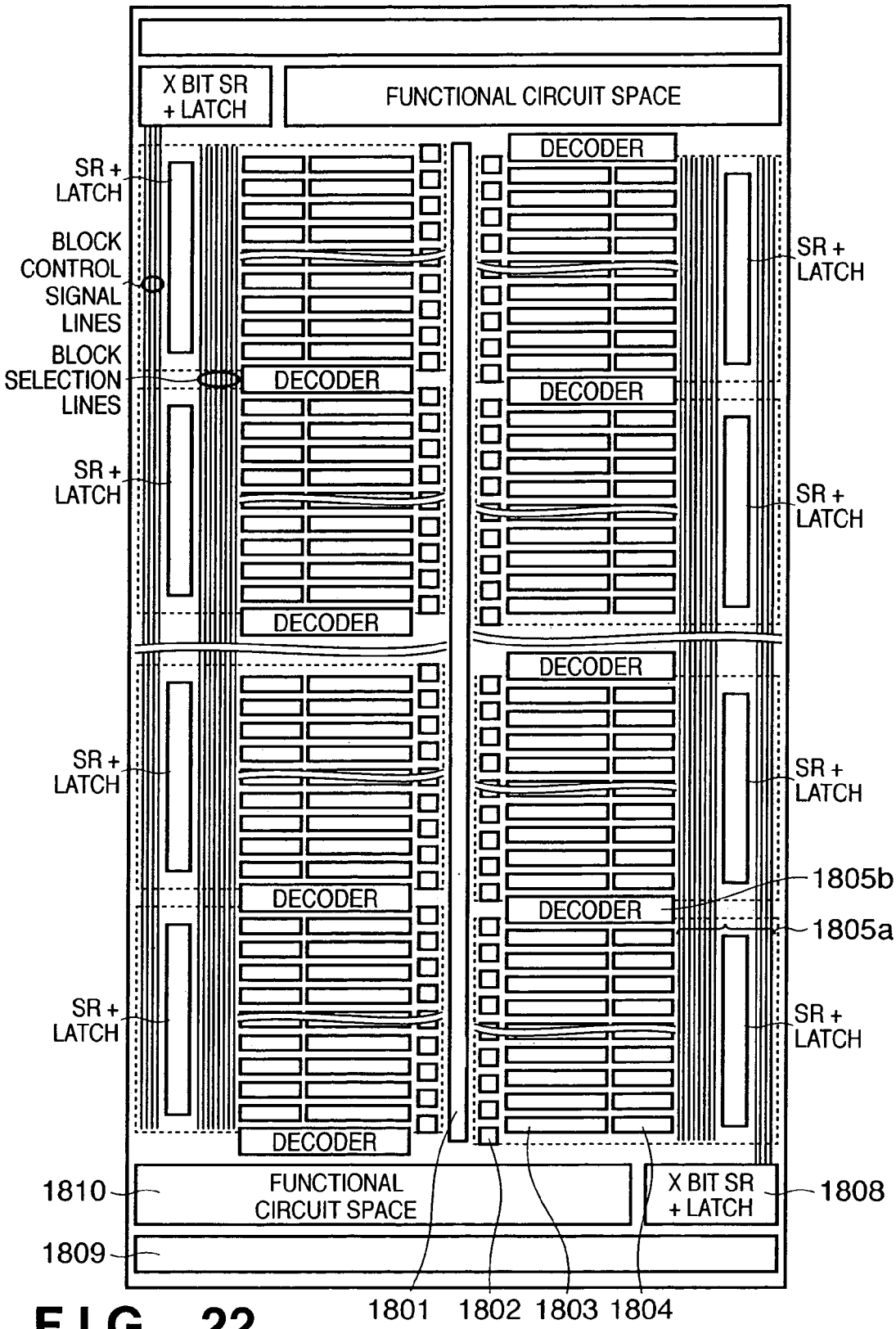
FIG. 22 is a view showing an example of a layout on an element board according to the variation of the fifth embodiment.

In this case, the modification effectively utilizes a space generated between groups. FIG. 21 is a circuit diagram showing a circuit configuration according to the modification, and FIG. 22 is a view showing an example of an actual layout on an element board according to the modification. In FIGS. 21 and 22, the same reference numerals as those in FIGS. 17 and 18 showing the fifth embodiment denote the same parts for an easy comparison.

In the modification, as shown in FIG. 22, the decoders 105' which are laid out at the portion 1805 in FIG. 18 are laid out in spaces 1805*b* between the groups of the portions 1803 and 1804 at which driver transistors and logic circuits are laid out. That is, the decoder 105' in FIG. 22 is arranged perpendicular to the direction shown in FIG. 18, and in detail, the decoder is so arranged that the longitudinal direction of the decoder is parallel to the shorter side of the element board. This facilitates the layout and wiring at a portion 1805*a*, and the short side of the element board can also be downsized.

In this manner, the modification can implement a more efficient circuit layout in comparison with the fifth embodiment because divided decoders are inserted in spaces between groups.

Sixth Embodiment

In the conventional layout, both the shift register+latch circuit and the decoder are laid out at the end of an element board. In the sixth embodiment, only the shift register+latch circuit is laid out at the end, similar to the conventional layout, and the decoder is laid out along the heater array.

It is effective to divisionally lay out decoders along heaters, like the sixth embodiment, when the space of a functional circuit on an element board increases and the circuit layout space at the end of an element board decreases, or when the number of bits of a shift register is large and a space for laying out a decoder cannot be ensured at the end.

Figure 23:
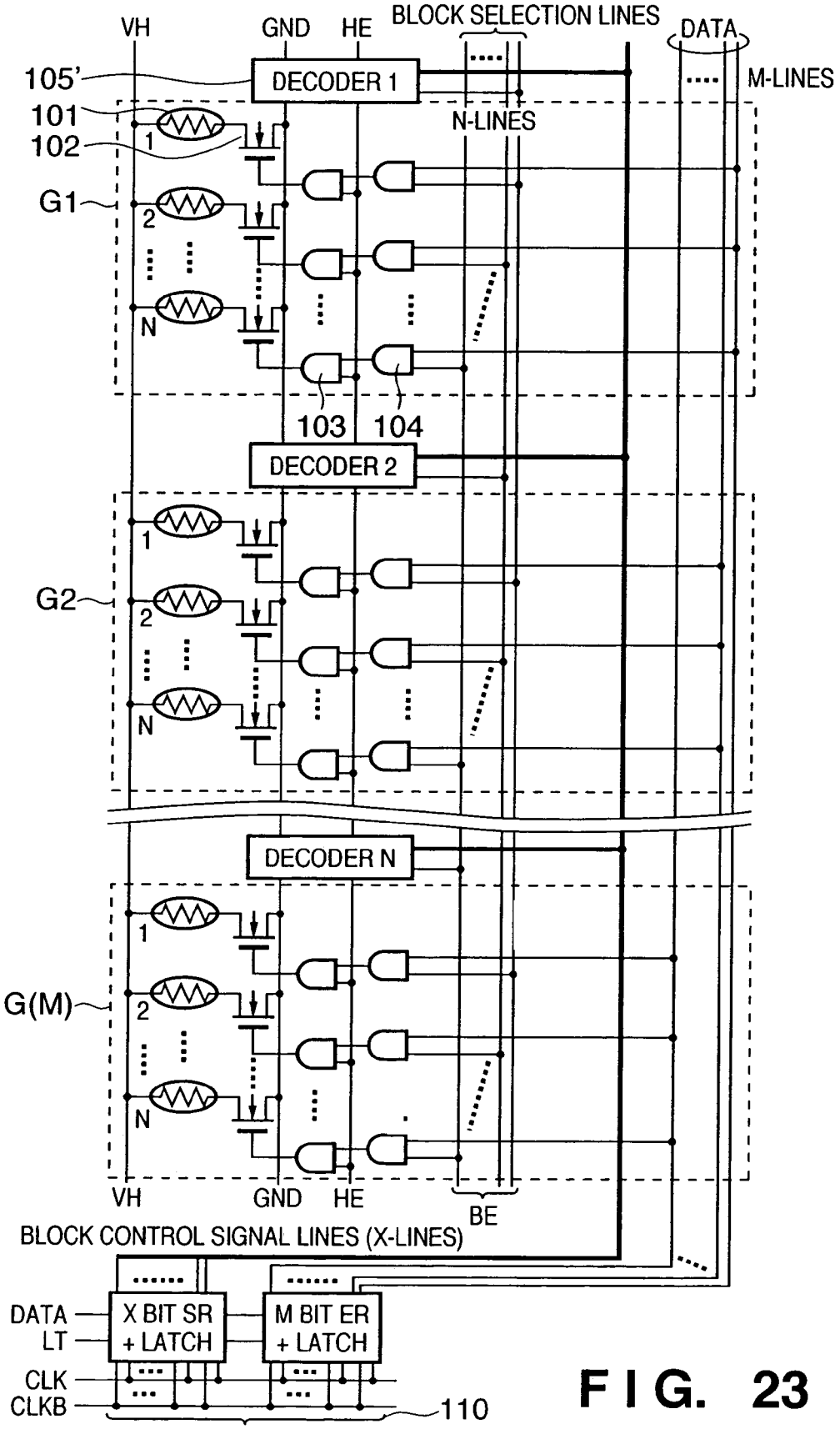
FIG. 23 is a circuit diagram according to the sixth embodiment of the present invention.
Figure 24:
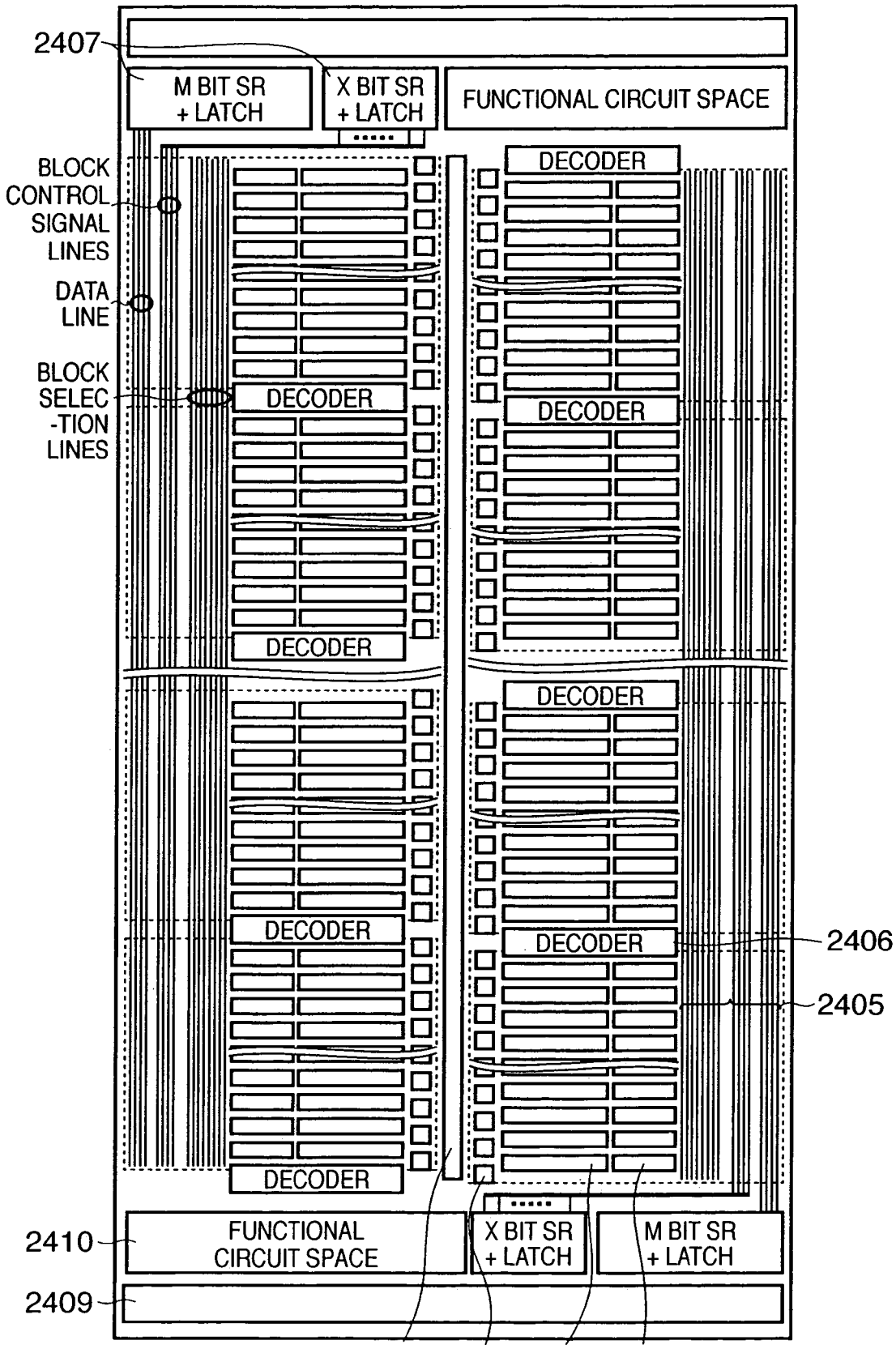
FIG. 24 is a view showing an example of a layout on an element board according to the sixth embodiment.

FIG. 23 is a circuit diagram showing a circuit configuration according to the sixth embodiment. FIG. 24 is a view showing an example of an actual layout on an element board according to the sixth embodiment.

In this embodiment, as shown in FIG. 24, on the both sides of an ink supply port arranged in the middle of the element board along the longitudinal direction, two heater arrays including M×N heaters are arranged symmetrically, and driver transistors and logic circuits for respective groups are extending along the shorter sides of the element board. Decoder circuits are arranged adjacent to the driver transistors and logic circuits for respective groups. Shift register+latch circuits are arranged on both ends of longitudinal direction along the direction crossing to the heater array.

In FIG. 23, reference numerals 101 denote heaters; 102, driver transistors; 103 and 104, logic circuits; 105', decoders; and 110, a shift register+latch circuit. The correspondence between the respective portions in FIG. 23 and FIG. 24 showing the layout example will be explained. An ink supply port is laid out in a region 2401; the heaters 101, in a region 2402; the driver transistors 102, in a region. 2403; the logic circuits 103 and 104, in a region 2404; a data line, block control line, and block selection line, in a region 2405; the decoder 105', in a region 2406; the shift register+latch circuit 110, in a region 2407; input/output pads, in a region 2409; and a functional circuit, in a region 2410.

According to the sixth embodiment, by inserting divided decoders into spaces between groups, a wide space can be ensured at the end of a substrate even on a substrate having a large number of heaters, similar to a substrate having a small number of heaters. An additional functional circuit can be formed in a space at the end of the substrate, a circuit formed on the element board can attain a more advanced function, and the cost can be reduced.

Modification to Sixth Embodiment

In the sixth embodiment, the decoders 105' are interposed between the circuits of respective groups. This layout is possible only when the circuits of each group can be laid out closer to each other along the long side.

Figure 25:
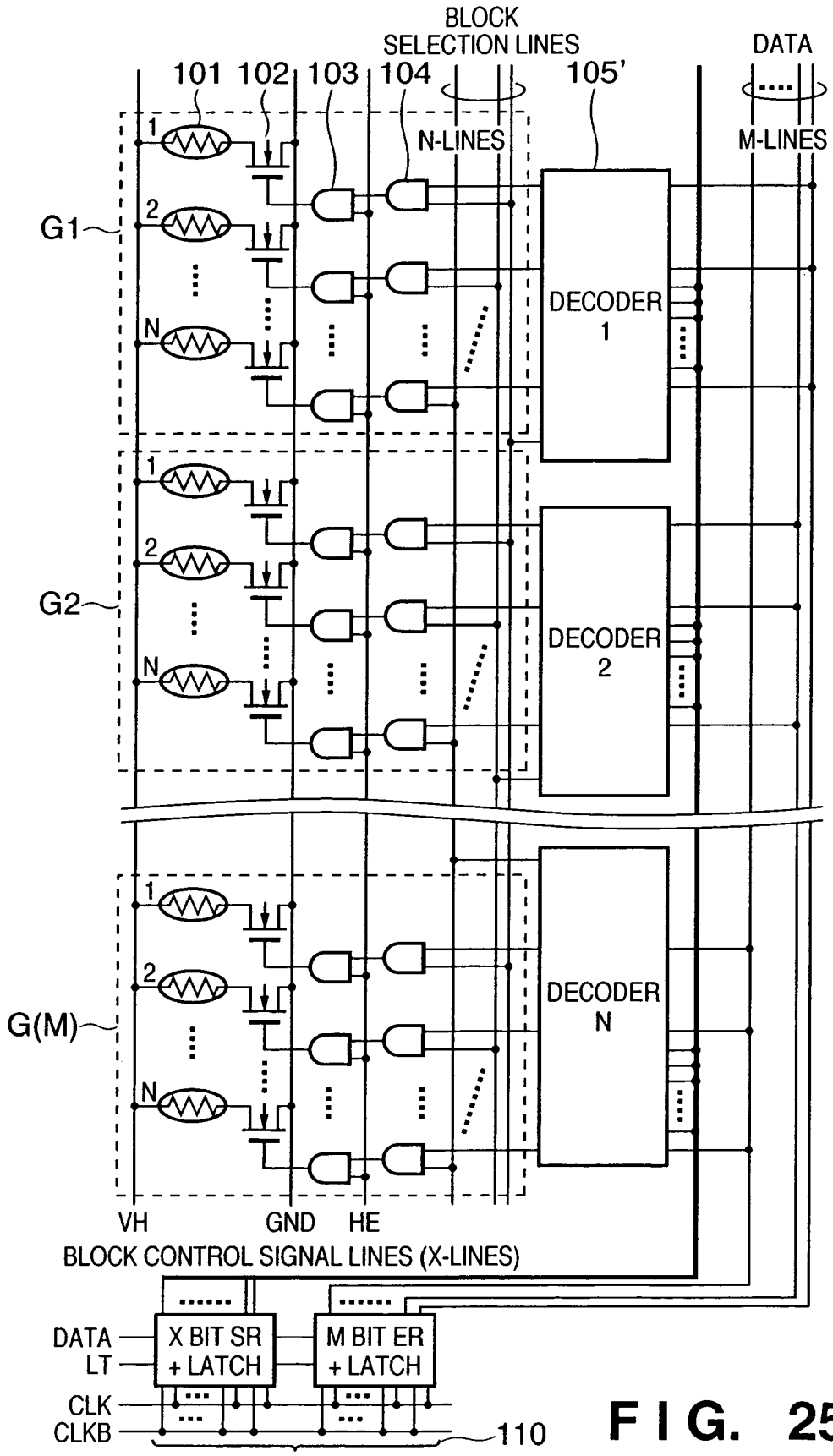
FIG. 25 is a circuit diagram according to a variation of the sixth embodiment.
Figure 26:
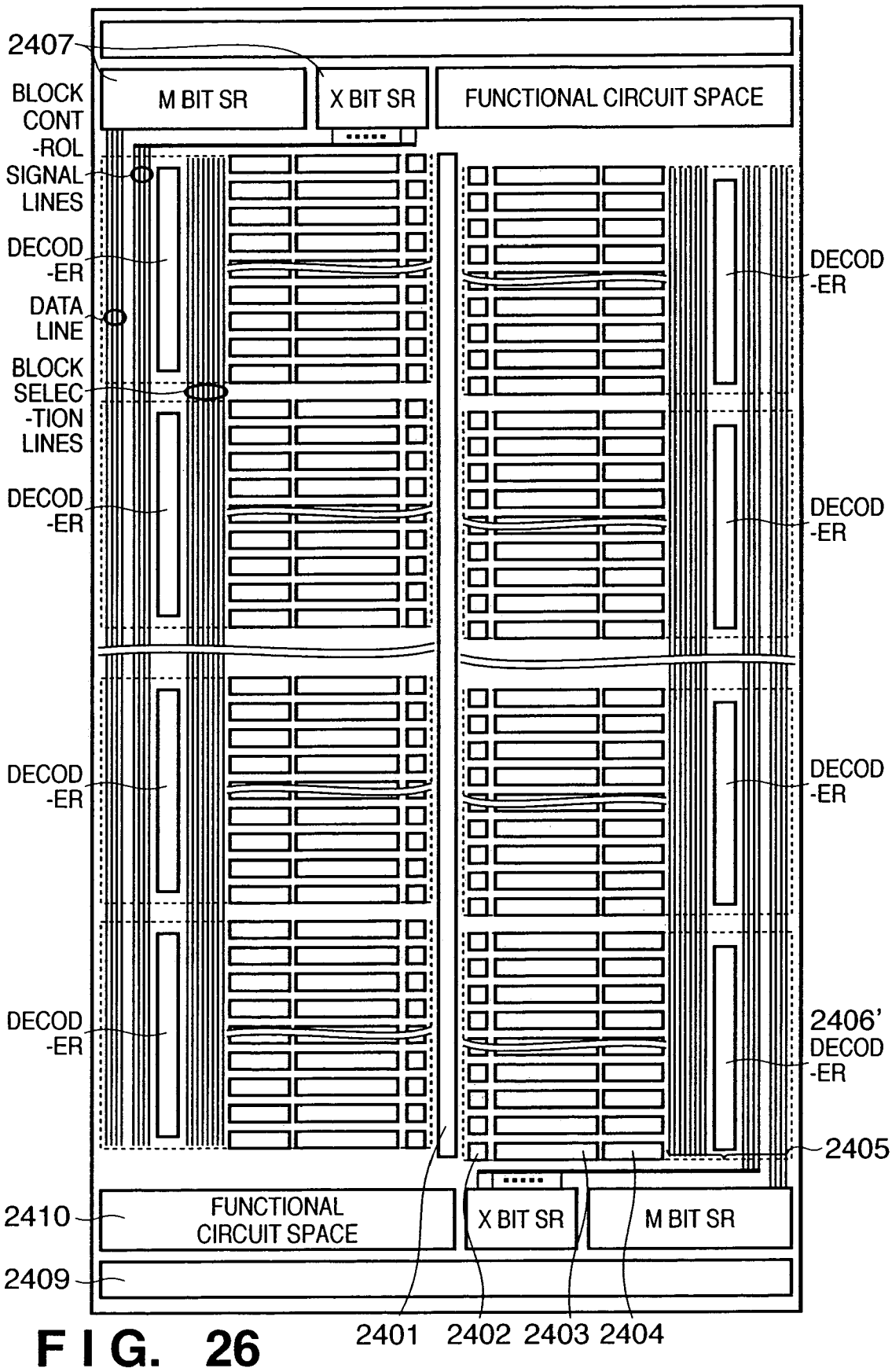
FIG. 26 is a view showing an example of a layout on an element board according to the variation of the sixth embodiment.

In this modification, decoders corresponding to respective groups are arranged along the heater array when there is not margin for inserting circuits between groups. FIG. 25 is a circuit diagram showing a circuit configuration according to the modification. FIG. 26 is a view showing an example of an actual layout on an element board according to the modification. In FIGS. 25 and 26, the same reference numerals as those in FIGS. 23 and 24 showing the sixth embodiment denote the same parts for an easy comparison. In this modification, the decoder 105' is laid out in a region 2406' along the heater array 2401.

This modification can also obtain the same effects as those of the sixth embodiment.

Seventh Embodiment

In the fifth embodiment, decoders are inserted between shift registers, and laid out in a line within the region 1805. However, when heaters are arranged at a higher density, the group layout width narrows even at the same time division number N, and it becomes difficult to insert decoders between shift registers.

Also when the element size is large due to limitations on the semiconductor process, it becomes difficult to insert decoders between shift registers.

In this case, according to the seventh embodiment, decoders and shift registers are arranged parallel to each other in two lines.

Figure 27:
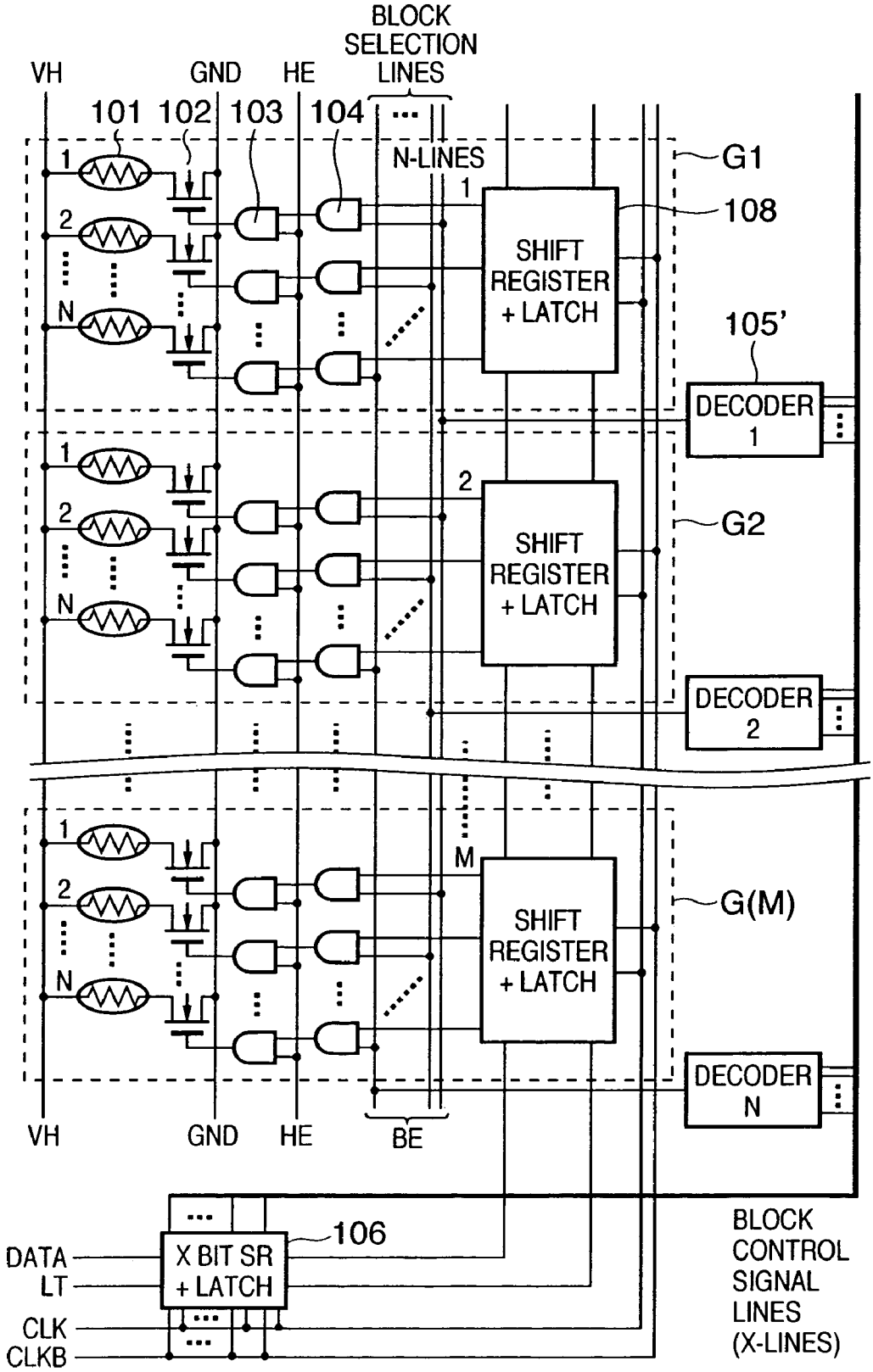
FIG. 27 is a circuit diagram according to the seventh embodiment of the present invention.
Figure 28:
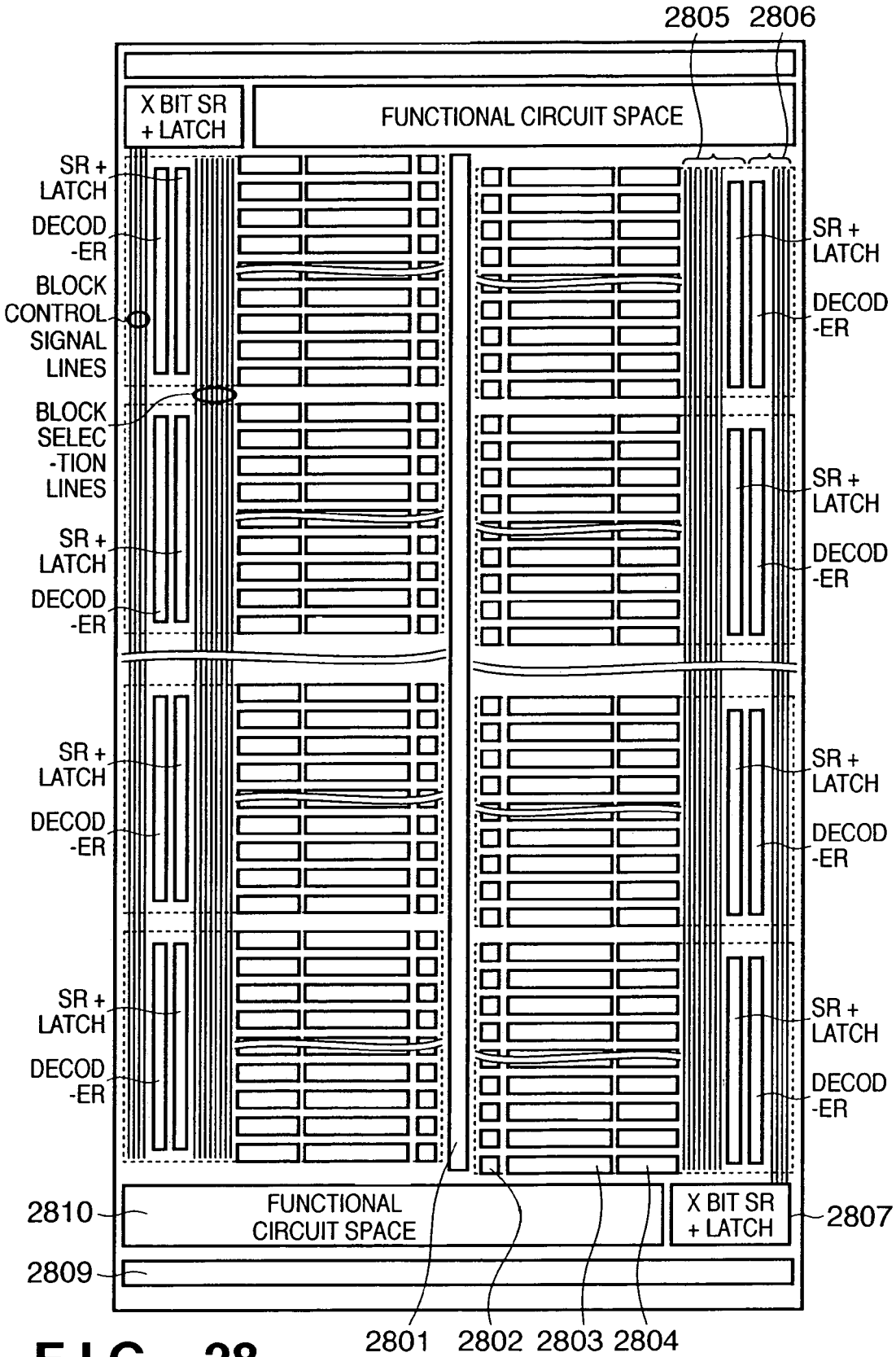
FIG. 28 is a view showing an example of a layout on an element board according to the seventh embodiment.

FIG. 27 is a circuit diagram showing a circuit configuration according to the seventh embodiment. FIG. 28 is a view showing an example of an actual layout on an element board according to the seventh embodiment.

In this embodiment, as shown in FIG. 28, on the both sides of an ink supply port arranged in the middle of the element board along the longitudinal direction, two heater arrays including M×N heaters are arranged symmetrically, and driver transistors, logic circuits, Shift register+latch circuits and decoder circuits for respective groups are extending along the shorter sides of the element board in turn. Shift register+latch circuits and functional circuits are arranged on both sides of longitudinal direction of the element board.

In FIG. 27, reference numerals 101 denote heaters; 102, driver transistors; 103 and 104, logic circuits; 105', decoders; 106, an X-bit shift register+latch circuit; and 108, shift registers+latch circuits corresponding to respective groups. The correspondence between the respective portions in FIG. 27 and FIG. 28 showing the layout example will be explained. An ink supply port is laid out in a region 2801; the heaters 101, in a region 2802; the driver transistors 102, in a region 2803; the logic circuits 103 and 104, in a region 2804; the shift registers+latch circuits 108 and data lines, in a region 2805; block control lines and the decoders 105', in a region 2806; the shift register+latch circuit 106, in a region 2807; input/output pads, in a region 2809; and a functional circuit, in a region 2810.

The seventh embodiment adopts the same circuit configuration as that in FIG. 17 according to the fifth embodiment except that the region 2806 in which the decoders 105' are laid out is set parallel to the region 2805 in which the shift registers 108 are arranged.

This layout widens the substrate along the short side, compared to the fifth embodiment, but can ensure a wide space at the end of the substrate, similar to the fifth embodiment. A functional circuit having an additional function can be efficiently formed at the end of the substrate.

If the number of heaters increases and the substrate becomes long, the number of circuits can be increased in a direction in which the substrate becomes long, similar to the fifth embodiment. Circuits can be laid out more efficiently than the conventional circuit layout, and the cost can be reduced.

Other Embodiment

The above-described embodiments have exemplified a so-called bubble-jet® type inkjet printhead which abruptly heats and gasifies ink by using a heating element (heater) as a printing element and discharges ink droplets from an orifice by the pressure of generated bubbles. The present invention can be evidently applied to a printhead which prints by another method as far as the printhead has a printing element array formed from a plurality of printing elements.

In this case, the heater in the embodiments is replaced with a printing element used in each method.

Of ink-jet printing systems, the embodiments can adopt a system which comprises a means (e.g., an electrothermal transducer) for generating thermal energy as energy utilized to discharge ink and changes the ink state by thermal energy. This ink-jet printing system can increase the printing density and resolution.

The present invention is not limited to the printhead and printhead element board described in the above embodiments, but can also be applied to a printhead cartridge having the printhead and an ink container which holds ink to be supplied to the printhead, an apparatus (e.g., a printer, copying machine, or facsimile apparatus) which mounts the printhead and has a control means for supplying printing data to the printhead, and a system formed from a plurality of devices (e.g., a host computer, interface device, reader, and printer) including the above apparatus.

A printing apparatus having the above-described printhead, the mechanical structure of the printhead, and a printhead cartridge will be exemplified with reference to the accompanying drawings.

<Description of Inkjet Printing Apparatus>

Figure 10:
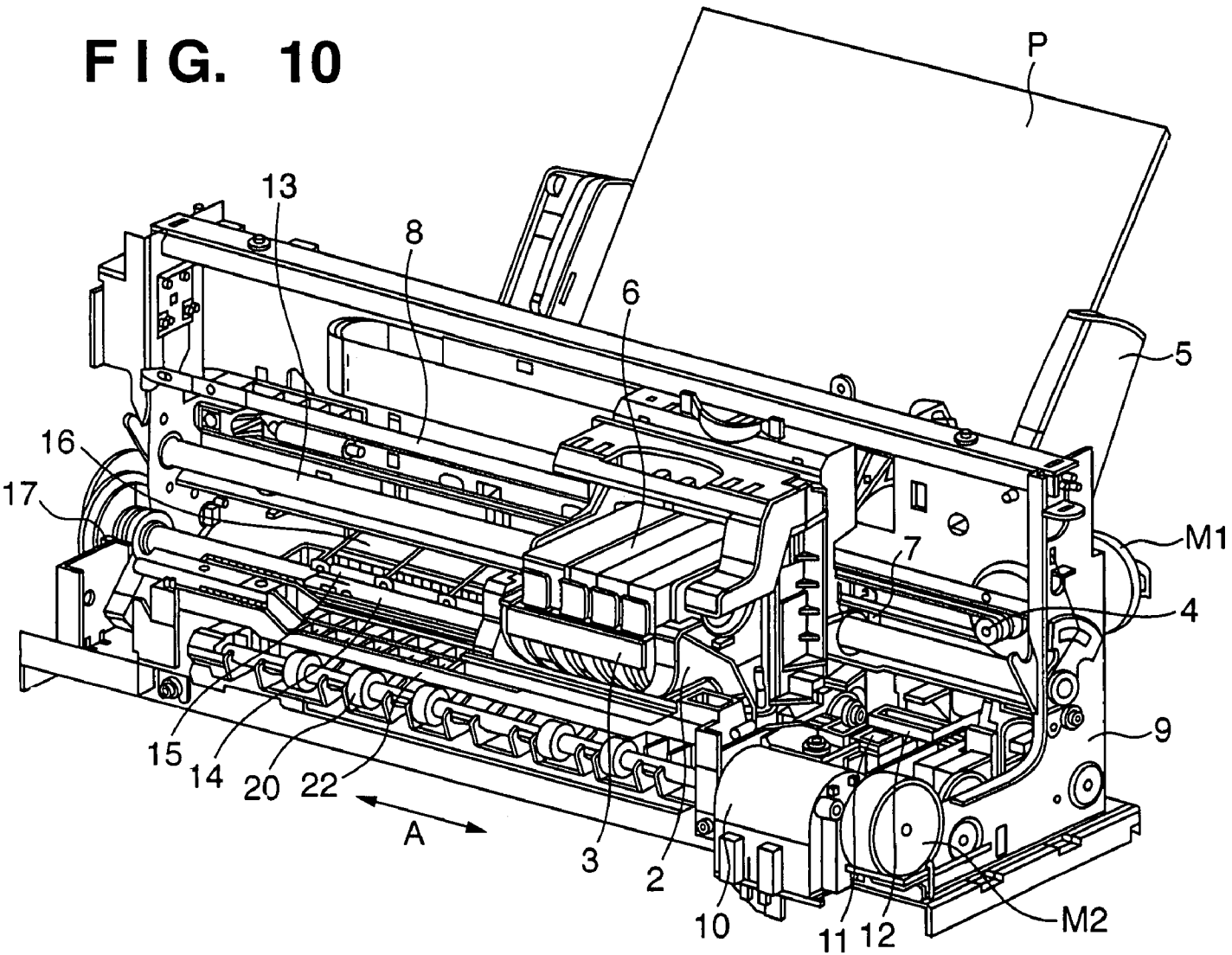
FIG. 10 is an outer perspective view showing the schematic structure of an inkjet printing apparatus which prints with the printhead according to the present invention.

FIG. 10 is an outer perspective view showing the schematic structure of an inkjet printing apparatus which prints with the printhead according to the present invention.

As shown in FIG. 10, in the inkjet printing apparatus (to be referred to as a printing apparatus hereinafter), a transmission mechanism 4 transmits a driving force generated by a carriage motor M1 to a carriage 2 which supports a printhead 3 for discharging ink to print by the inkjet method. The carriage 2 reciprocates in a direction indicated by an arrow A. A printing medium P such as a printing sheet is fed via a sheet feed mechanism 5, and conveyed to a printing position. At the printing position, the printhead 3 discharges ink to the printing medium P to print.

In order to maintain a good state of the printhead 3, the carriage 2 is moved to the position of a recovery device 10, and a discharge recovery process for the printhead 3 is executed intermittently.

The carriage 2 of the printing apparatus supports not only the printhead 3, but also an ink cartridge 6 which stores ink to be supplied to the printhead 3. The ink cartridge 6 is detachably mounted on the carriage 2.

The printing apparatus shown in FIG. 10 can print in color. For this purpose, the carriage 2 supports four ink cartridges which respectively store magenta (M), cyan (C), yellow (Y), and black (K) inks. The four ink cartridges are independently detachable.

The carriage 2 and printhead 3 can achieve and maintain a predetermined electrical connection by properly bringing their contact surfaces into contact with each other. The printhead 3 selectively discharges ink from a plurality of orifices and prints by applying energy in accordance with the printing signal. In particular, the printhead 3 according to the embodiment adopts an inkjet method of discharging ink by using thermal energy, and comprises an electrothermal transducer in order to generate thermal energy. Electric energy applied to the electrothermal transducer is converted into thermal energy. Ink is discharged from orifices by utilizing a pressure change caused by the growth and contraction of bubbles by film boiling generated by applying the thermal energy to ink. The electrothermal transducer is arranged in correspondence with each orifice, and ink is discharged from a corresponding orifice by applying a pulse voltage to a corresponding electrothermal transducer in accordance with the printing signal.

As shown in FIG. 10, the carriage 2 is coupled to part of a driving belt 7 of the transmission mechanism 4 which transmits the driving force of the carriage motor M1. The carriage 2 is slidably guided and supported along a guide shaft 13 in the direction indicated by the arrow A. The carriage 2 reciprocates along the guide shaft 13 by normal rotation and reverse rotation of the carriage motor M1. A scale 8 which represents the absolute position of the carriage 2 is arranged along the moving direction (direction indicated by the arrow A) of the carriage 2. In the embodiment, the scale 8 is prepared by printing black bars on a transparent PET film at a necessary pitch. One end of the scale 8 is fixed to a chassis 9, and the other end is supported by a leaf spring (not shown).

The printing apparatus has a platen (not shown) in opposition to the orifice surface having the orifices (not shown) of the printhead 3. Simultaneously when the carriage 2 supporting the printhead 3 reciprocates by the driving force of the carriage motor M1, a printing signal is supplied to the printhead 3 to discharge ink and print on the entire width of the printing medium P conveyed onto the platen.

In FIG. 10, reference numeral 14 denotes a convey roller which is driven by a convey motor M2 in order to convey the printing medium P; 15, a pinch roller which makes the printing medium P abut against the convey roller 14 by a spring (not shown); 16, a pinch roller holder which rotatably supports the pinch roller 15; and 17, a convey roller gear which is fixed to one end of the convey roller 14. The convey roller 14 is driven by rotation of the convey motor M2 that is transmitted to the convey roller gear 17 via an intermediate gear (not shown).

Reference numeral 20 denotes a discharge roller which discharges the printing medium P bearing an image formed by the printhead 3 outside the printing apparatus. The discharge roller 20 is driven by transmitting rotation of the convey motor M2. The discharge roller 20 abuts against a spur roller (not shown) which presses the printing medium P by a spring (not shown). Reference numeral 22 denotes a spur holder which rotatably supports the spur roller.

As shown in FIG. 10, in the printing apparatus, the recovery device 10 which recovers the printhead 3 from a discharge failure is arranged at a desired position (e.g., a position corresponding to the home position) outside the reciprocation range (printing area) for printing operation of the carriage 2 supporting the printhead 3.

The recovery device 10 comprises a capping mechanism 11 which caps the orifice surface of the printhead 3, and a wiping mechanism 12 which cleans the orifice surface of the printhead 3. The recovery device 10 performs a discharge recovery process in which a suction means (suction pump or the like) within the recovery device forcibly discharges ink from orifices in synchronism with capping of the orifice surface by the capping mechanism 11, thereby removing ink with a high viscosity or bubbles in the ink channel of the printhead 3.

In non-printing operation or the like, the orifice surface of the printhead 3 is capped by the capping mechanism 11 to protect the printhead 3 and prevent evaporation and drying of ink. The wiping mechanism 12 is arranged near the capping mechanism 11, and wipes ink droplets attached to the orifice surface of the printhead 3.

The capping mechanism 11 and wiping mechanism 12 can maintain a normal ink discharge state of the printhead 3.

<Control Configuration of Inkjet Printing Apparatus>

Figure 11:
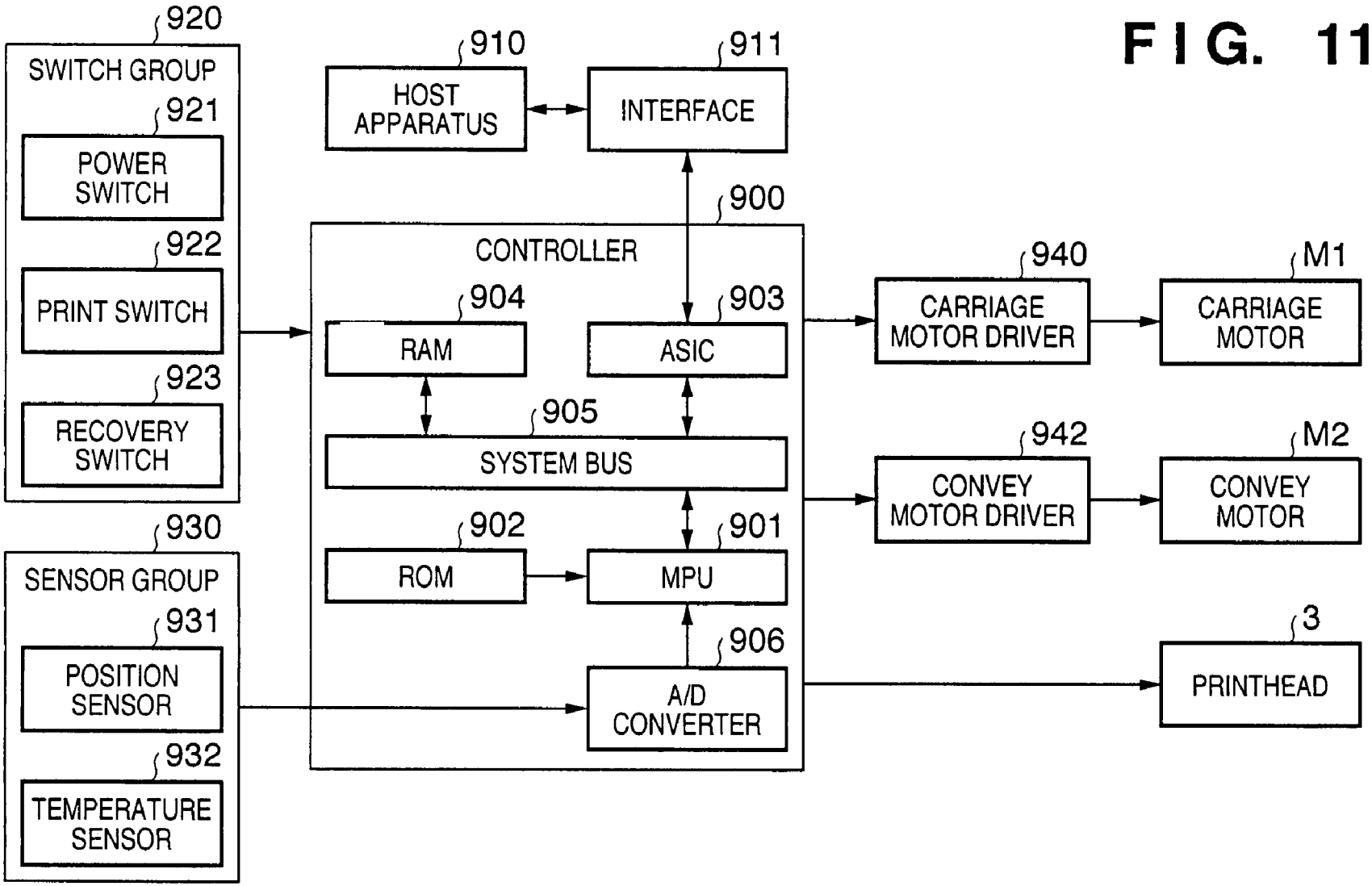
FIG. 11 is a block diagram showing the control configuration of the printing apparatus shown in FIG. 10.

FIG. 11 is a block diagram showing the control configuration of the printing apparatus shown in FIG. 10.

As shown in FIG. 11, a controller 900 comprises an MPU 901, a ROM 902 which stores a program corresponding to a control sequence (to be described later), a predetermined table, and other permanent data, an ASIC (Application Specific IC) 903 which generates control signals for controlling the carriage motor M1, the convey motor M2, and the printhead 3, a RAM 904 having a printing data mapping area, a work area for executing a program, and the like, a system bus 905 which connects the MPU 901, ASIC 903, and RAM 904 to each other and exchanges data, and an A/D converter 906 which A/D-converts analog signals from a sensor group (to be described below) and supplies digital signals to the MPU 901.

In FIG. 11, reference numeral 910 denotes a host apparatus such as a computer (or an image reader, digital camera, or the like) serving as a printing data supply source. The host apparatus 910 and printing apparatus transmit/receive printing data, commands, status signals, and the like via an interface (I/F) 911.

Reference numeral 920 denotes a switch group which is formed from switches for receiving instruction inputs from the operator, such as a power switch 921, a print switch 922 for designating the start of print, and a recovery switch 923 for designating the activation of a process (recovery process) of maintaining good ink discharge performance of the printhead 3. Reference numeral 930 denotes a sensor group which detects the state of the apparatus and includes a position sensor 931 such as a photocoupler for detecting a home position h and a temperature sensor 932 arranged at a proper portion of the printing apparatus in order to detect the ambient temperature.

Reference numeral 940 denotes a carriage motor driver which drives the carriage motor M1 for reciprocating the carriage 2 in the direction indicated by the arrow A; and 942, a convey motor driver which drives the convey motor M2 for conveying the printing medium P.

In printing and scanning by the printhead 3, the ASIC 903 transfers driving data (DATA) for a printing element (discharge heater) to the printhead while directly accessing the storage area of the ROM 902.

<Printhead Structure>

Figure 12:
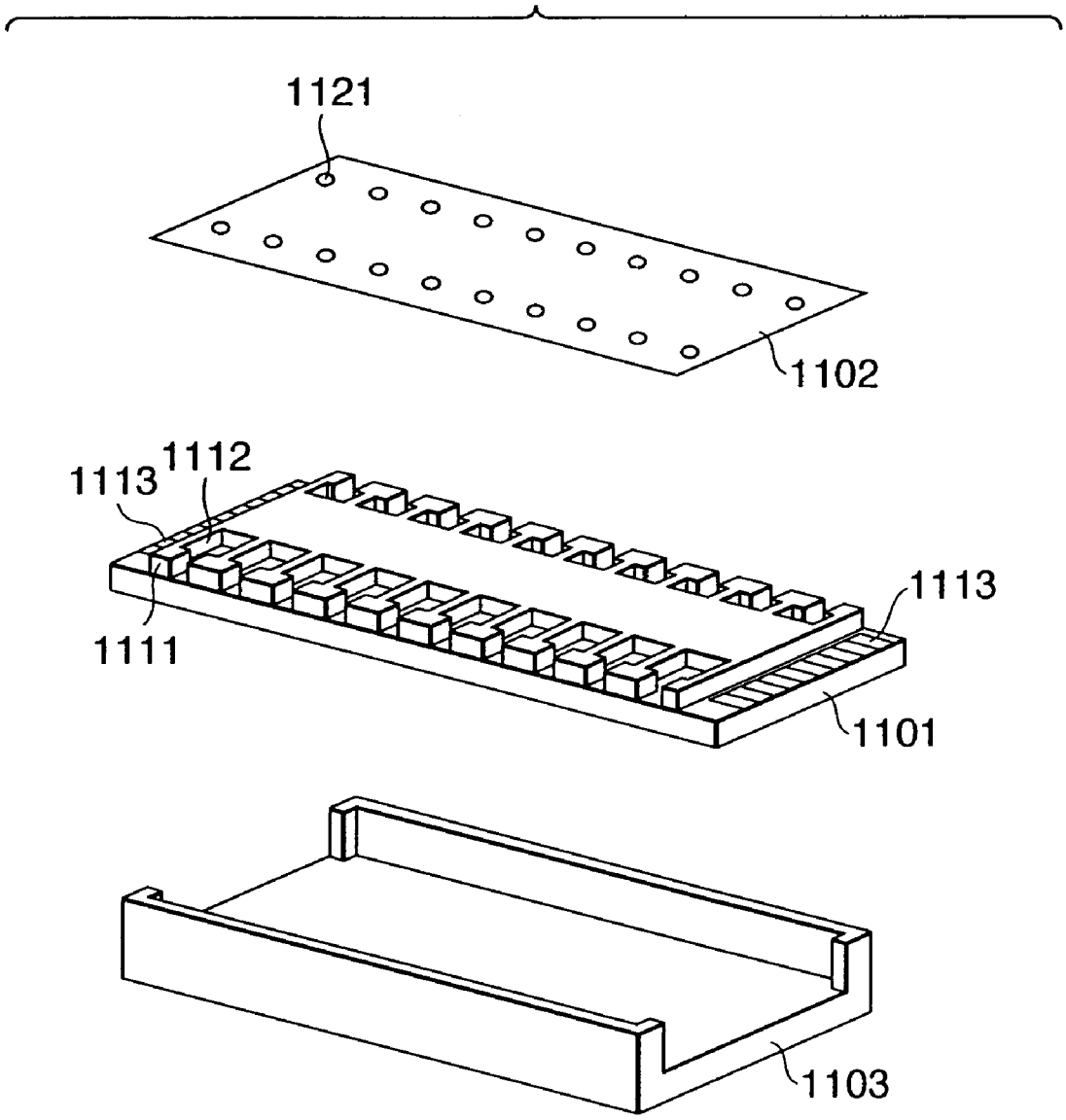
FIG. 12 is an exploded perspective view showing the mechanical structure of an inkjet printhead used in the printing apparatus of FIG. 10.

FIG. 12 is an exploded perspective view showing the mechanical structure of the printhead 3 used in the above-described printing apparatus.

In FIG. 12, reference numeral 1101 denotes an element board prepared by building a circuit configuration (to be described later) into a substrate of silicon or the like. On the element board, heating resistors 1112 are formed as electrothermal transducers which form printing elements. Channels 1111 are formed around the resistors toward the two sides of the substrate. A member which forms the channels can be made of a resin (e.g., dry film), SiN, or the like.

In FIG. 12, reference numeral 1102 denotes an orifice plate which has a plurality of orifices 1121 in correspondence with positions at which they face the heating resistors 1112. The orifice plate 1102 is joined to the member which forms the channels.

In FIG. 12, reference numeral 1103 denotes a wall member which forms a common liquid chamber for supplying ink. Ink is supplied from the common liquid chamber to the channels so as to flow at the periphery of the element board 1101.

Connection terminals 1113 for receiving data and signals from the printing apparatus main body are formed on the two sides of the element board 1101.

<Printhead Cartridge>

The present invention can also be applied to a printhead cartridge having the above-described printhead and an ink tank for holding ink to be supplied to the printhead. The form of the printhead cartridge may be a structure integrated with the ink tank or a structure separable from the ink tank.

Figure 13:
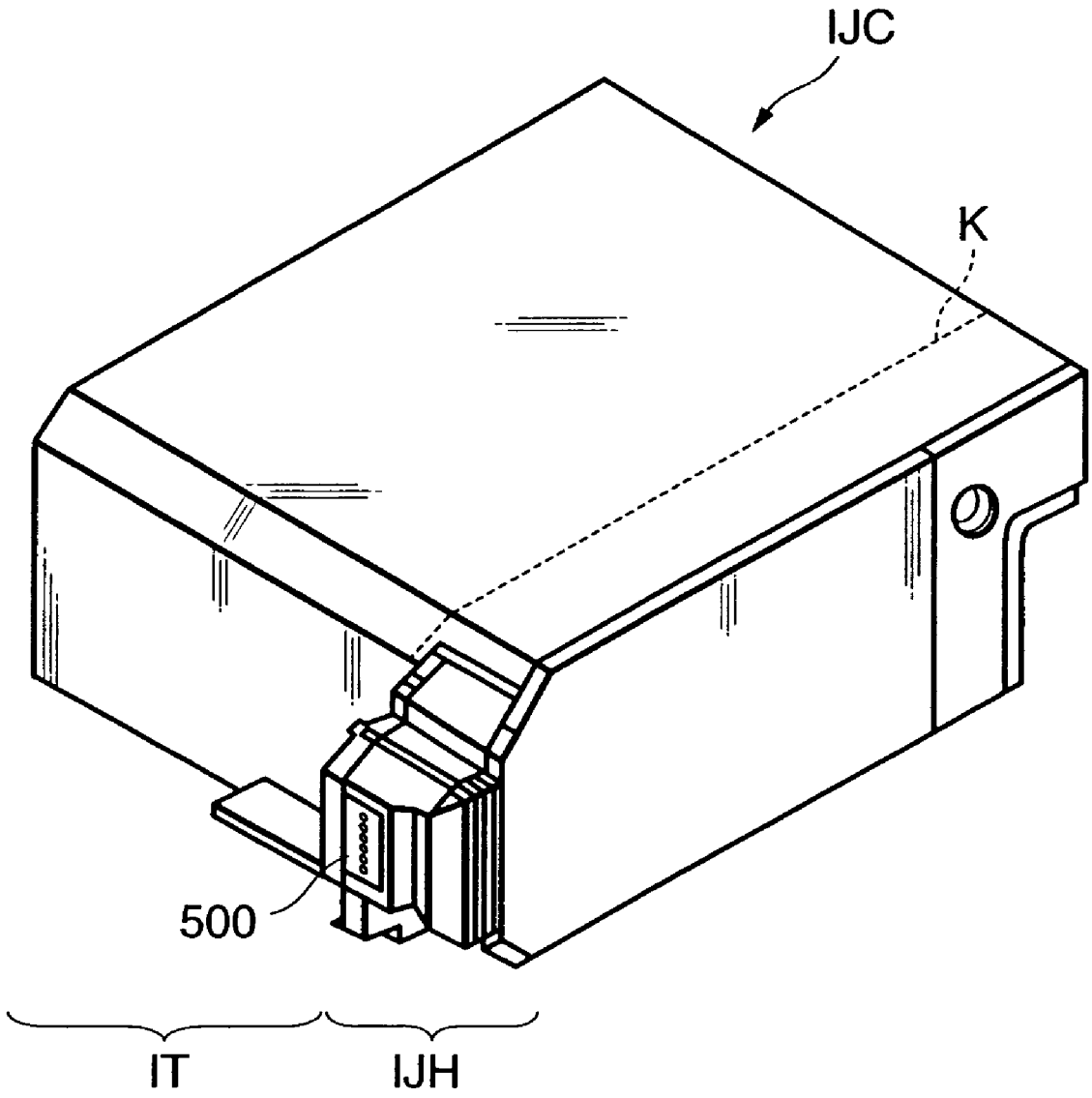
FIG. 13 is an outer perspective view showing the structure of a printhead cartridge obtained by integrating an ink tank and printhead.

FIG. 13 is an outer perspective view showing the structure of a printhead cartridge IJC obtained by integrating an ink tank and printhead. Inside the printhead cartridge IJC, an ink tank IT and printhead IJH are separated at the position of a boundary K shown in FIG. 13, but cannot be individually replaced. The printhead cartridge IJC has an electrode (not shown) for receiving an electrical signal supplied from a carriage HC when the printhead cartridge IJC is mounted on the carriage HC. This electrical signal drives the printhead IJH to discharge ink, as described above.

The printhead cartridge may be so configured as to fill or refill ink in the ink tank.

In FIG. 13, reference numeral 500 denotes an ink orifice array having a black nozzle array and color nozzle array. The ink tank IT is equipped with a fibrous or porous ink absorber in order to hold ink.

Figure 14:
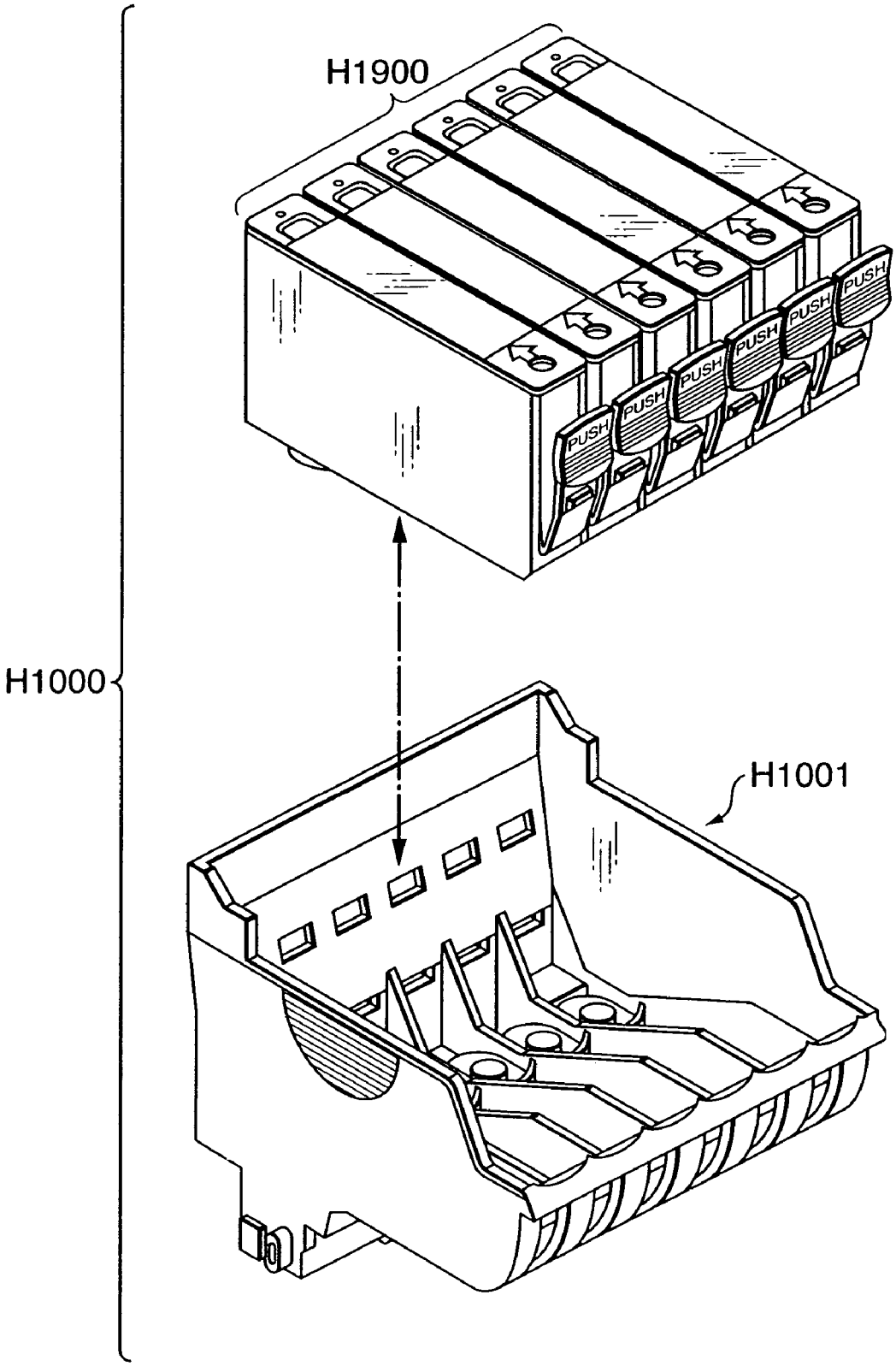
FIG. 14 is an outer perspective view showing the structure of a printhead cartridge in which an ink tank and printhead are separable.

FIG. 14 is an outer perspective view showing the structure of a printhead cartridge in which an ink tank and printhead are separable. A printhead cartridge H1000 comprises an ink tank H1900 which stores ink, and a printhead H1001 which discharges, from a nozzle, ink supplied from the ink tank H1900 in accordance with printing information. The printhead cartridge H1000 adopts a so-called cartridge system in which the printhead cartridge H1000 is detachably mounted on the carriage.

In the printhead cartridge H1000 shown in FIG. 14, independent ink tanks for, black, light cyan, light magenta, cyan, magenta, and yellow are prepared as ink tanks in order to implement photographic high-quality color printing. As shown in FIG. 14, these ink tanks are freely detachable from the printhead H1001.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application Nos. 2003-421353 filed on Dec. 18, 2003 and 2004-350301 filed on Dec. 2, 2004, which are hereby incorporated by reference herein.

What is claimed is:

1. An element board for a printhead comprising:

an ink supply port which has an elongated shape for supplying ink;

a plurality of printing elements aligned along a longitudinal side of the ink supply port;

driving circuits which drive said printing elements;

a plurality of element selection circuits which select printing elements within each group for each group having a predetermined number of adjacent printing elements, on the basis of image data; and a plurality of driving selection circuits which select one of said printing elements in each group, wherein said printing elements, said driving circuits, and said element selection circuits are sequentially arranged from the side of the ink supply port, said element selection circuits and said driving selection circuits are further arranged adjacent to said driving circuit of each group, and each of said driving selection circuits is further arranged adjacent to a corresponding one of said element selection circuits.

2. The element board according to claim 1, wherein said printing elements and said driving circuits are arranged, respectively, on two sides of the ink supply port of the element board.

3. The element board according to claim 1, wherein a pad portion for electrical connection is formed along a side of the element board which is perpendicular to a longitudinal direction of said ink supply port.

4. The element board according to claim 1, wherein said element selection circuits are arranged between said driving circuits respectively corresponding to adjacent ones of the groups.

5. The element board according to claim 1, wherein said driving selection circuits are further arranged between said driving circuits corresponding to adjacent ones of the groups.

6. The element board according to claim 1, wherein one of said plurality of driving circuits and one of said plurality of element selection circuits which correspond to a respective group are arranged parallel to each other within a length of said printing elements of the respective group in said predetermined direction.

7. The element board according to claim 1, wherein one of said plurality of driving selection circuits is arranged in a line with one of said plurality of element selection circuits of a corresponding one of the groups.

8. The element board according to claim 7, wherein said one of said plurality of element selection circuits includes a one-bit shift register and a latch, connected in series.

9. The element board according to claim 1, wherein one of said plurality of driving selection circuits is arranged parallel to one of said plurality of element selection circuits of a corresponding one of the groups.

10. The element board according to claim 1, wherein said printing element includes a thermal transducer which generates thermal energy for discharging ink.

11. The element board according to claim 1, wherein each of said plurality of element selection circuits includes a shift register and a latch.

12. The element board according to claim 1, wherein said driving circuit comprises a driving transistor and an AND circuit in correspondence with each of said printing elements.

13. The element board according to claim 1, wherein each of said plurality of driving selection circuits includes a decoder.

14. A printhead comprising: an element board including an ink supply port which has an elongated shape for supplying ink;

a plurality of printing elements aligned along a longitudinal side of the ink supply port;

driving circuits which drive said printing elements;

a plurality of element selection circuits which select printing elements within each group, each group having a predetermined number of adjacent printing elements, on the basis of image data; and a plurality of driving selection circuits which select one of said printing elements in each group, wherein said printing elements, said driving circuits, and said element selection circuits are sequentially arranged from the side of the ink supply port, said element selection circuits and said driving selection circuits are further arranged adjacent to said driving circuit of each group, each of said driving selection circuits is further arranged adjacent to a corresponding one of said element selection circuits, and orifices which discharge ink are formed in correspondence with said printing elements, respectively.

15. A printhead cartridge comprising: a printhead including an element board, said element board including an ink supply port which has an elongated shape for supplying ink;

a plurality of printing elements aligned along a longitudinal side of the ink supply port;

driving circuits which drive said printing elements;

a plurality of element selection circuits which select printing elements within each group, each group having a predetermined number of adjacent printing elements, on the basis of image data; and a plurality of driving selection circuits which select one of said printing elements in each group, wherein said printing elements, said driving circuits, and said element selection circuits are sequentially arranged from the side of the ink supply port, said element selection circuits and said driving selection circuits are further arranged adjacent to said driving circuit of each group, each of said driving selection circuits is further arranged adjacent to a corresponding one of said element selection circuits, and said printhead including orifices which discharge ink and are formed in correspondence with said printing elements, respectively; and an ink container which holds ink to be supplied to said printhead.

16. The cartridge according to claim 15, wherein said ink container is filled or refilled with ink.

17. A printing apparatus comprising:

a printhead including an element board, said element board including an ink supply port which has an elongated shape for supplying ink;

a plurality of printing elements aligned along a longitudinal side of the ink supply port;

driving circuits which drive said printing elements;

a plurality of element selection circuits which select printing elements within each group for each group having a predetermined number of adjacent printing elements, on the basis of image data; and a plurality of driving selection circuits which select one of said printing elements in each group, wherein said printing elements, said driving circuits, and said element selection circuits are sequentially arranged from the side of the ink supply port, said element selection circuits and said driving selection circuits are further arranged adjacent to said driving circuit of each group, each of said driving selection circuits is further arranged adjacent to a corresponding one of said element selection circuits, and said printhead includes orifices which discharge ink and are formed in correspondence with said printing elements, respectively; and control means for transmitting the image data to said printhead.

18. An element board for a printhead comprising:

an ink supply port which has an elongated shape for supplying ink;

a plurality of thermal transducers aligned along a longitudinal side of the ink supply port, for generating thermal energy for discharging ink;

driving circuits which drive said thermal transducers;

a plurality of shift registers which select thermal transducers within each group for each group having a predetermined number of adjacent thermal transducers, on the basis of image data; and a plurality of decoders or a plurality of circuits each composing a part of a decoder which select one of said thermal transducers in each group, wherein said thermal transducers, said driving circuits, and said plurality of shift registers are sequentially arranged from the side of the ink supply port, said plurality of shift registers, and said plurality of decoders or said plurality of circuits are further arranged adjacent to said driving circuit of each group, said thermal transducers and said driving circuits are sequentially arranged, respectively, on both longitudinal sides of the ink supply port of the element board, and each of said decoders or said circuits is further arranged adjacent to a corresponding one of said shift registers.

* * * * *